US008418278B2

(12) United States Patent
Mochita et al.

(10) Patent No.: US 8,418,278 B2
(45) Date of Patent: Apr. 16, 2013

(54) SANITARY WASHING DEVICE

(75) Inventors: Masayuki Mochita, Fukuoka-ken (JP); Minoru Sato, Fukuoka-ken (JP); Akihiro Uemura, Fukuoka-ken (JP); Hiroshi Hashimoto, Fukuoka-ken (JP)

(73) Assignee: Toto Ltd, Fukuoka (JP)

( * ) Notice: Subject to any disclaimer, the term of this patent is extended or adjusted under 35 U.S.C. 154(b) by 408 days.

(21) Appl. No.: 12/922,493

(22) PCT Filed: Feb. 5, 2010

(86) PCT No.: PCT/JP2010/051723

§ 371 (c)(1),
(2), (4) Date: Sep. 14, 2010

(87) PCT Pub. No.: WO2010/092911

PCT Pub. Date: Aug. 19, 2010

(65) Prior Publication Data

US 2011/0061160 A1 Mar. 17, 2011

(30) Foreign Application Priority Data

Feb. 12, 2009 (JP) ..... 2009-029255
Mar. 24, 2009 (JP) ..... 2009-071825
Jun. 17, 2009 (JP) ..... 2009-144720
Jun. 17, 2009 (JP) ..... 2009-144740

(51) Int. Cl.
*A47K 3/022* (2006.01)

(52) U.S. Cl.
USPC ..... 4/433; 4/420.2

(58) Field of Classification Search ..... 4/443–445, 4/447, 420.1–420.5
See application file for complete search history.

(56) References Cited

U.S. PATENT DOCUMENTS 5,390,277 A * 2/1995 Van Wagner et al. ..... 392/485
5,826,282 A * 10/1998 Matsumoto et al. ..... 4/420.4
6,754,912 B1 * 6/2004 Hayashi et al. ..... 4/420.2
7,191,473 B2 * 3/2007 Matsumoto et al. ..... 4/420.2

FOREIGN PATENT DOCUMENTS

JP 2001-090151 A 4/2001
JP 2001-173068 A 6/2001
JP 3264274 A 12/2001
JP 2002-155567 A 5/2002

OTHER PUBLICATIONS

International Search Report for PCT/JP2010/051723 dated Mar. 9, 2010.

* cited by examiner

*Primary Examiner* — Huyen Le
(74) *Attorney, Agent, or Firm* — Pearne & Gordon LLP

(57) ABSTRACT

A sanitary washing device includes a washing nozzle including a water discharge port; and a pressurizing device for pressurizing the wash water from the water discharge port, the device being configured to perform a first and a second water discharge process, in the first process, the wash water discharged later in a first time span higher than pressure of wash water discharged at beginning of the first water discharge process so that the wash water discharged later in the first time span overtakes and unites with the wash water discharged at beginning of the first water discharge process to form a first water drop at a predetermined position, in the second process, the pressure of wash water discharged later in the second time span higher than pressure of wash water discharged at beginning of the second water discharge process so that the wash water discharged later in the second time span overtakes and unites with the wash water discharged at beginning of the second water discharge process to form a second water drop at a predetermined position from the water discharge port.

19 Claims, 18 Drawing Sheets

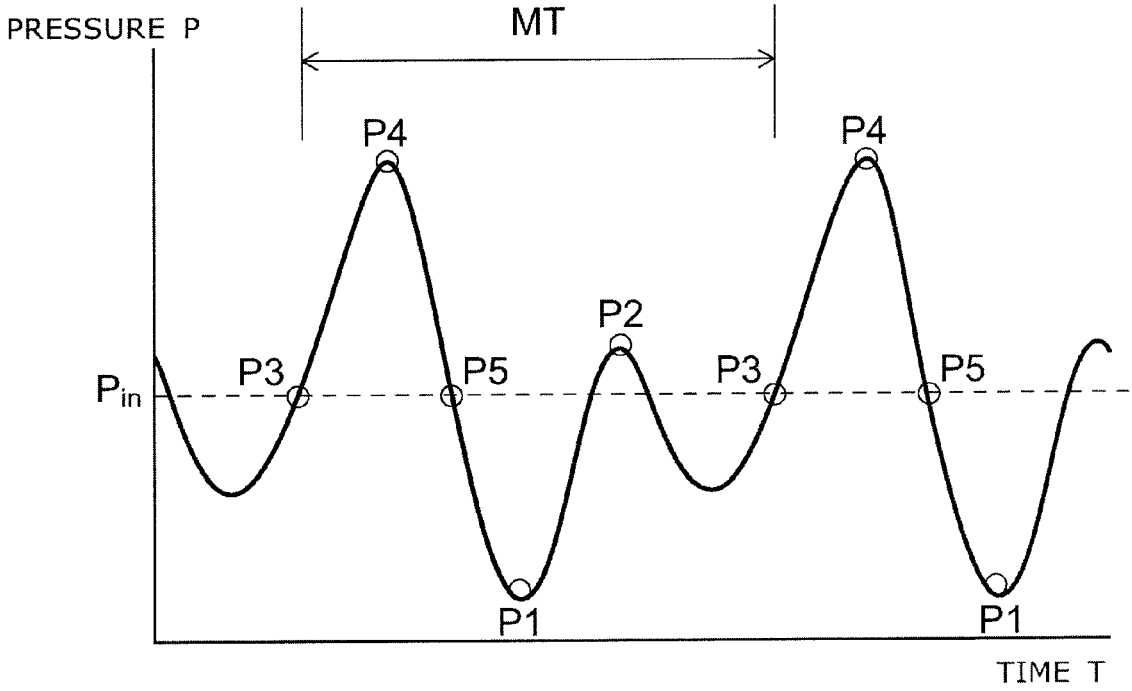
FIG. 3
FIG. 4A
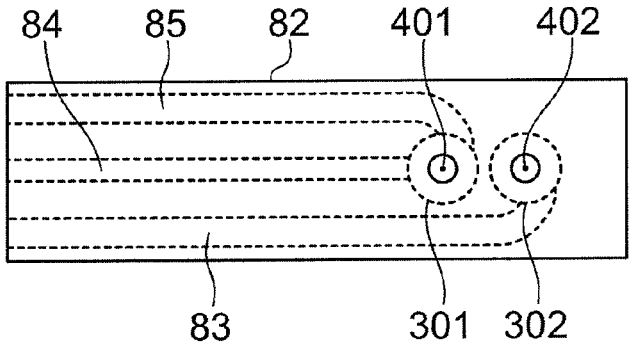
FIG. 4B
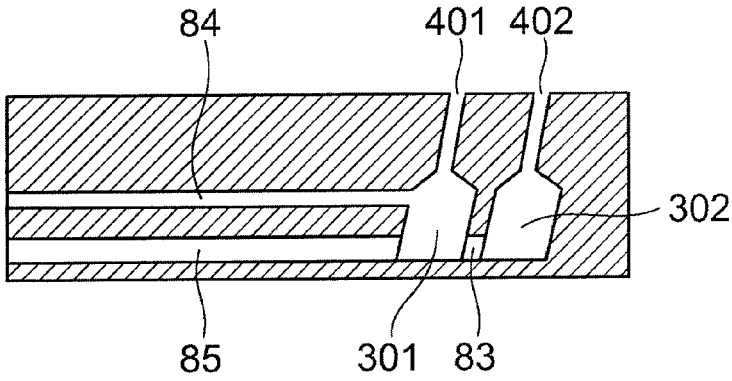

| NAME | SHAPE OF WATER DISCHARGE GROUP | VELOCITY WAVEFORM |
|---|---|---|
| [I] FAST WATER DISCHARGE GROUP | | |
| [II] LARGE WATER DISCHARGE GROUP | | |
| [III] SCATTERED WATER DISCHARGE GROUP | | |

VELOCITY WAVEFORM

OVERTAKING CURVE

FIG. 10

SANITARY WASHING DEVICE

TECHNICAL FIELD

Aspects of this invention relate generally to a sanitary washing device, such as a human body private part washing device for washing the private parts of a human body and a shower device for washing away bodily dirt.

BACKGROUND ART

Sanitary washing devices are rapidly becoming popular, because they can make the human body clean by washing it with wash water.

In this context, a sanitary washing device is proposed including a pressure generating section for causing a pulsating transition in which a pressure higher than the water discharge pressure obtained from the supply water source is intermittently generated so as to achieve a comfortable washing feeling even with a reduced amount of water used (see Patent Document 1).

This sanitary washing device disclosed in Patent Document 1 can perform water discharge with increased velocity and repeatedly pulsating flow by causing the pulsating transition of pressure.

Thus, after discharge from the washing nozzle, discharged waters with different velocities unite into a large water drop, which can be caused to impinge on the human body. More specifically, a discharged water with a fast velocity overtakes a discharged water discharged earlier with a slow velocity to form a large water drop. Although discharged from the washing nozzle as a small water drop, a large water drop has been formed at the time of impingement on the human body. Thus, the disclosed technique is superior in being able to provide a comfortable washing feeling even with low supply flow rate.

However, the technique disclosed in Patent Document 1 has a problem in which there is a tradeoff between the "feeling of stimulation", or the feeling of being strongly washed by wash water with a fast velocity, and the "feeling of volume", or the feeling of being washed by a large amount of wash water. Specifically, to enlarge the water drop, which is formed using velocity difference between discharged waters, it is necessary to decrease the discharged water velocity to ensure overtaking of the subsequent discharged water. However, because of the slowdown in discharged water velocity, the "feeling of stimulation" decreases. Conversely, to enhance the "feeling of stimulation", it is necessary to accelerate the discharged water velocity. However, if the discharged water velocity is accelerated, the previous discharged water cannot overtake the subsequent discharged water in a predetermined distance, failing to form a large water drop. Hence, the "feeling of volume" and the "feeling of stimulation" cannot be simultaneously achieved.

On the other hand, the inventors have investigated such techniques as in Patent Document 2 to realize a high washing feeling establishing compatibility between the feeling of volume and the feeling of stimulation.

Patent Document 2 discloses a sanitary washing device in which wash water is squirted straight from an orifice portion toward a water discharge port, passes through an air intake portion, and is discharged from the water discharge port (see claim 1, paragraphs 0006 to 0014, FIG. 2, etc. in Patent Document 2).

In this sanitary washing device disclosed in Patent Document 2, the surface of wash water is disturbed by the air taken in by the jet due to the air intake effect (ejector effect) to form a thin site and a thick site in the wash water. At the site where the wash water is thicker, in other words, where the wash water is denser, the discharged water causes the "feeling of volume" when impinging on the human body. Furthermore, because the wash water is squirted straight toward the water discharge port from the orifice portion for causing the ejector effect, it is possible to reduce energy loss due to collision of wash water with the nozzle inner wall surface, that is, to suppress the decrease in the "feeling of stimulation" due to deceleration of wash water. As compared with conventional sanitary washing devices, the technique is superior in being able to provide a high washing feeling establishing compatibility between the "feeling of volume" and the "feeling of stimulation".

However, although this technique disclosed in Patent Document 2 can establish compatibility between the "feeling of stimulation" and the "feeling of volume" when the flow rate is relatively high, it cannot achieve the "feeling of stimulation" and provides an insufficient "feeling of volume" when the flow rate is relatively low. That is, the problem is that the "feeling of stimulation" and "feeling of volume" cannot be achieved at low flow rate. Furthermore, because of the configuration of creating the feeling of volume by generating disturbances in the surface of wash water by the ejector effect and creating the feeling of stimulation by suppressing the decrease in the velocity of wash water obtained by the supply water pressure, there is a limit to increasing the difference in feeling between the feeling of volume and the feeling of stimulation, and improvement is desired also from the viewpoint of providing a washing feeling at high level. Furthermore, because of the need of a device for causing the ejector effect, there is a problem with the size increase and cost of the device.

[Patent Citation 1]

JP 3264274

JP 2002-155567

DISCLOSURE OF INVENTION

Technical Problem

Aspects of the invention have been made on the basis of the recognition of these problems, and are intended to provide a sanitary washing device capable of establishing compatibility between the "feeling of stimulation" and the "feeling of volume" with a small amount of water used and providing a comfortable washing feeling at high level.

Technical Solution

The invention is a sanitary washing device discharging supplied wash water toward a human body, including:

a washing nozzle including a water discharge port configured to discharge the wash water toward the human body; and a pressurizing device configured to pressurize the wash water and discharge it from the water discharge port, the sanitary washing device being configured to perform a first water discharge process having a first time span and a second water discharge process having a second time span, in the first water discharge process, the pressurizing device making pressure of wash water discharged later in the first time span higher than pressure of wash water discharged at beginning of the first water discharge process so that the wash water discharged later in the first time span overtakes and unites with the wash water discharged at beginning of the first water discharge process to form a first water drop at a predetermined position from the water discharge port, in the second water discharge process, the pressurizing device making pressure of wash water discharged later in the second time span higher than pressure of wash water discharged at beginning of the second water discharge process so that the wash water discharged later in the second time span overtakes and unites with the wash water discharged at beginning of the second water discharge process to form a second water drop at a predetermined position from the water discharge port, the pressurizing device making difference between pressure changes of wash water in the first water discharge process and pressure changes of wash water in the second water discharge process so that the first water drop is larger than the second water drop, the pressurizing device making maximum pressure of the wash water in the second water discharge process higher than maximum pressure of the wash water in the first water discharge process so that the second water drop is faster than the first water drop, and a water discharged by the first water discharge process and a water discharged by the second water discharge process being alternately discharged from the water discharge port.

In this sanitary washing device, wash water discharged from the water discharge port is pressurized so that the amount of overtaking by which the wash water discharged later overtakes the wash water discharged earlier is larger in the first water discharge process than in the second water discharge process to make the first water drop at the predetermined position larger in cross-sectional area than the second water drop, and that the maximum pressure of wash water in the second water discharge process is higher than the maximum pressure of wash water in the first water discharge process to make the velocity of the second water drop at the predetermined position faster than the velocity of the first water drop. Thus, the adopted technique creates a "first water drop having a large cross-sectional area and a slow velocity", that is, a "large drop" providing the feeling of volume, and a "second water drop having a small cross-sectional area and a fast velocity", that is, a "fast drop" providing the feeling of stimulation. Furthermore, because of the configuration in which the discharged water with the "feeling of stimulation" enhanced and the discharged water with the "feeling of volume" enhanced are alternately discharged from the water discharge port, it is possible to provide a comfortable washing feeling establishing compatibility between the "feeling of volume" and the "feeling of stimulation" while significantly suppressing the amount of water used.

The term "alternately discharged" used herein is not limited to discharge water in which discharged water by the first water discharge process and discharged water by the second water discharge process are discharged completely in turns, but any water discharge in which discharged water by the first water discharge process or discharged water by the second water discharge process is discharged between the discharged water by the first water discharge process and the discharged water by the second water discharge process is also expressed as alternate.

In the invention, a predetermined waiting time is preferably provided after completion of the first water discharge process and before beginning of the second water discharge process so that the second water drop formed in the second water discharge process does not overtake first water drop formed in the first water discharge process at the predetermined position.

This invention thus configured can prevent the second water drop with a fast velocity, or fast drop, from overtaking the first water drop with a slow velocity, or large drop, before impinging on the human body.

In other words, the "large drop" and the "fast drop" can be caused to impinge on the human body at different timings. Hence, it is possible to sufficiently provide each of the feeling of volume due to impingement of the "large drop" and the feeling of stimulation due to impingement of the "fast drop", and provide a very favorable washing feeling including both the feeling of stimulation and the feeling of volume even with a small amount of water.

In the invention, a time reducer configured to reduce time in which pressure of the wash water drops after the second water discharge process is preferably further included.

The wash water discharged in the time in which the pressure of wash water drops after the second water discharge process is the so-called wasted water unable to contribute to washing. Specifically, after the second water discharge process, the pressurizing device drops the pressure applied to the wash water to perform the first water discharge process for water discharge at a slow initial velocity, and hence the pressure of wash water drops. The wash water discharged during this pressure drop cannot overtake the wash water discharged earlier, and hence cannot contribute to forming any of the first and second water drop. Thus, it is wasteful water unable to contribute to providing a washing feeling.

By reducing time in which the pressure of wash water drops after the second water discharge process, it is possible to reduce time in which wasted water unable to contribute to generating the "large drop" and "fast drop". Thus, further water saving can be achieved.

Furthermore, by reducing time in which the pressure drops after the second water discharge process, it is possible to start the first water discharge process at an earlier time. This can prevent the interval between the "fast drop" and the "large drop" from being so long that the continuous feeling of water discharge is impaired. Furthermore, in the case where the first water discharge process and the second water discharge process are performed within a predetermined time, such as several ten to several hundred msec (milliseconds), to ensure the continuous feeling of water discharge, a longer waiting time can be provided after the first water discharge process by using the time reducer for reducing the time. This can more reliably prevent the "fast drop" from overtaking the "large drop".

In the invention, the waiting time is preferably provided so that a first time interval from when water discharge by the first water discharge process is discharged from the water discharge port until water discharge by the second water discharge process is discharged from the water discharge port is longer than a second time interval from when the water discharge by the second water discharge process is discharged from the water discharge port until the water discharge by the first water discharge process is discharged from the water discharge port.

In this sanitary washing device, by suitably setting the time interval between the water discharge by the first water discharge process and the water discharge by the second water discharge process from the water discharge port, it is possible to prevent extreme difference between the time interval from the impingement of the first water drop on the human body until the impingement of the second water drop on the human body and the time interval from the impingement of the second water drop on the human body until the impingement of the first water drop on the human body, and to reliably provide the continuous feeling of water discharge at the time of impingement on the human body.

In the invention, the waiting time is preferably provided so that time interval from when the first water drop formed in the first water discharge process impinges on the human body until the second water drop formed in the second water discharge process impinges on the human body is substantially equal to time interval from when the second water drop impinges on the human body until the first water drop impinges on the human body.

In this sanitary washing device, the time intervals between impingements of the "large drop" and the "fast drop" on the human body are equalized. Hence, the continuous feeling of water discharge can be felt more effectively.

In the invention, the pressure of the wash water at beginning of the first water discharge process is preferably made lower than supply water pressure.

This sanitary washing device can reliably decrease the initial velocity at the beginning of the first water discharge process. This enables the wash water discharged later in the first time span to reliably overtake the wash water discharged earlier. Hence, the cross-sectional area of the first water drop can be further increased.

In the invention, the pressure of the wash water at beginning of the second water discharge process is preferably made higher than the pressure of the wash water at beginning of the first water discharge process.

This sanitary washing device can provide a large difference in velocity between the first water drop by the first water discharge process and the second water drop by the second water discharge process. Hence, the cross-sectional area of the "large drop" can be further increased by slowing down the initial velocity at the beginning of the first water discharge process to further increase the amount of overtaking by which the wash water discharged later overtakes the wash water discharged earlier. On the other hand, the velocity of the "fast drop" can be further accelerated by increasing the initial velocity at the beginning of the second water discharge process. Thus, it is possible to provide a favorable washing feeling establishing compatibility between the "feeling of volume" and the "feeling of stimulation".

In the invention, increment of pressure of wash water per unit time during the first time span in the first water discharge process is preferably made smaller than increment of pressure of wash water per unit time during the second time span in the second water discharge process.

In this sanitary washing device, in the first water discharge process, the pressure of wash water is increased relatively slowly, and thereby the velocity (initial velocity) of the wash water discharged from the water discharge port increases relatively slowly. Hence, at the predetermined position, the amount of overtaking by which the wash water discharged later overtakes the wash water discharged earlier can be further increased. Thus, the large drop for causing the feeling of volume can be generated in a larger size.

On the other hand, in the second water discharge process, the pressure of wash water is increased relatively rapidly, and thereby the velocity (initial velocity) of the wash water discharged from the water discharge port increases relatively rapidly. Hence, although the amount of water is small, a water drop with a relatively fast velocity can be generated.

That is, in the process for generating the large drop for causing the feeling of volume, the cross-sectional area of the first water drop can be further increased by ensuring a sufficient amount of overtaking. Furthermore, in the process for generating the fast drop for causing the feeling of stimulation, although the amount of water is small, a water drop with a relatively fast velocity can be generated. Hence, it is possible to realize highly comfortable washing which reliably establishes compatibility between the feeling of volume and the feeling of stimulation while reducing the total amount of water used.

In the invention, the pressurizing device preferably includes a pressurizer configured to apply pressure to the wash water, the pressurizer performs a first pressurization on the wash water in the first water discharge process, and the pressurizer further performs a second pressurization on the wash water in the second water discharge process.

In this sanitary washing device, by using the pressurizer to perform pressurization in the first water discharge process and the second water discharge process, the timing and cycle for performing the first water discharge process and the second water discharge process can be easily configured.

In the invention, the pressurizer preferably includes one pressurizing section, and the one pressurizing section performs the first pressurization and the second pressurization.

In this sanitary washing device, because the pressurizing section is single, the pressurizer can be downsized as a whole.

In the invention, the pressurizer preferably includes a cylinder connected to a supply water conduit, a plunger movably provided inside the cylinder, a check valve provided inside the plunger, and a coil configured to move the plunger forward and backward under control of an exciting voltage, and a check valve is disposed so that the pressure of the wash water increases when position of the plunger is changed to a side of the water discharge port, and that the pressure of the wash water decreases when the position of the plunger is changed to a side opposite to the water discharge port.

This sanitary washing device is structured so that the operation of the pressurizer is controlled by turning on/off the energization of the coil. Hence, the operation of the pressurizer can be easily configured.

In the invention, the pressurizer preferably includes a first pressurizing section and a second pressurizing section, the first pressurizing section performs the first pressurization on the wash water in the first water discharge process, and the second pressurizing section performs the second pressurization on the wash water in the second water discharge process.

In this sanitary washing device, by providing a first pressurizer for performing the first water discharge process and a second pressurizer for performing the second water discharge process, the pressure change in the first water discharge process and the pressure change in the second water discharge process can be made different although the operation itself of each pressurizer has a simple structure. Thus, the "large drop" and the "fast drop" can be formed more easily.

In the invention, the pressurizing device preferably includes: a pressurizer configured to apply pressure to the wash water; and a pressure accumulator provided between the pressurizer and the water discharge port and configured to accumulate the pressure of the wash water, and part of the pressure applied to the wash water by the pressurizer in the second water discharge process is accumulated in the pressure accumulator, and the accumulated pressure is applied to the wash water in the first water discharge process.

In this sanitary washing device, in the second water discharge process for performing water discharge with a faster velocity, the pressurizer is activated to form a second water drop, and part of the pressure is accumulated in the pressure accumulator. Thus, formation of the first water drop in the first water discharge process can be performed by the accumulated pressure. This can reduce the workload of the pressurizer and improve the durability of the pressurizer. Furthermore, because the pressurizer and the pressure accumulator are provided, the first water discharge process and the second water discharge process can use pressurizing methods suitable for respective water discharge characteristics.

In the invention, the pressure accumulator preferably applies the accumulated pressure to the wash water when the pressure of the wash water becomes lower than supply water pressure in the first water discharge process.

The initial velocity at the beginning of the first water discharge process can be reliably decreased. This can increase the amount of overtaking by which the wash water discharged later overtakes the wash water discharged earlier in the first time span. Thus, the "large drop" can be further enlarged.

In the invention, the pressure accumulator is preferably formed as an elastically deformable hose used for a supply water conduit connecting between the pressurizer and the water discharge port.

In this sanitary washing device, the pressure accumulator is an elastically deformable hose, and hence can be implemented in an extremely simple configuration. In addition, this can also lead to downsizing and cost reduction of the sanitary washing device.

In the invention, in the first water discharge process, the pressure accumulator preferably applies the pressure to the wash water, and the pressurizer performs the first pressurization.

In this sanitary washing device, in the first water discharge process, both the pressurization by the pressure accumulator and the pressurization by the pressurizer can be applied to wash water. This can facilitate adjusting the rate of increase of the initial velocity in the first water discharge process, and increase the amount of overtaking.

In the invention, at beginning of water discharge in the first water discharge process, the pressure accumulator preferably applies the pressure to the wash water, and in second half of the first time span in the first water discharge process, the pressurizer performs the first pressurization.

In this sanitary washing device, by applying pressurization by the pressure applicator in addition to release of the accumulated pressure, when the initial velocity of wash water discharged from the water discharge port increases, the rate of increase of the initial velocity can also be maintained at a high level. Thus, the amount of overtaking can be increased, and washing with a higher feeling of volume can be realized.

In the invention, time in which the first pressurization in the first water discharge process is performed by the pressurizer is preferably shorter than time in which second pressurization in the second water discharge process is performed.

In this sanitary washing device, the pressurizing time in the first water discharge process can be reduced. Hence, the durability of the pressurizer can be further improved.

In the invention, a time reducer configured to reduce time in which pressure drops after the second water discharge process is preferably included.

The wash water discharged in the time in which the inner pressure of the washing nozzle drops after the second water discharge process is the so-called wasted water unable to contribute to washing. Specifically, after the second water discharge process, the pressurizing device drops the pressure applied to the wash water to perform the first water discharge process for water discharge at a slow initial velocity, and hence the inner pressure of the washing nozzle drops. The wash water discharged during this pressure drop cannot overtake the wash water discharged earlier, or is not overtaken by the wash water discharged later, and hence cannot contribute to forming any of the first and second water drop. Furthermore, because of the low rate of flow from the washing nozzle, such water discharge unable to contribute to forming the water drop cannot provide a sufficient washing feeling to the human body. Thus, it is wasteful water unable to contribute to providing a washing feeling.

By reducing time in which the inner pressure of the washing nozzle drops after the second water discharge process, it is possible to reduce time in which wasted water unable to contribute to generating the "large drop" and "fast drop". Thus, further water saving can be achieved.

Furthermore, by reducing time in which the pressure drops after the second water discharge process, it is possible to start the first water discharge process at an earlier time. This can prevent the interval between the "fast drop" and the "large drop" from being so long that the continuous feeling of water discharge is impaired. Furthermore, in the case where the first water discharge process and the second water discharge process are performed within a predetermined time, such as several ten to several hundred msec (milliseconds), to ensure the continuous feeling of water discharge, a longer waiting time can be provided after the first water discharge process by using the time reducer for reducing the time. This can more reliably prevent the "fast drop" from overtaking the "large drop".

BRIEF DESCRIPTION OF DRAWINGS

FIG. 3 is a schematic diagram for illustrating the state of pressure variation of wash water.

FIG. 4A is a schematic plan view for illustrating a washing nozzle, and FIG. 4B is a schematic cross-sectional view for illustrating a washing nozzle.

FIG. 10 is a view showing an example of the velocity waveform of pulsating transition and the shape of generated water discharge groups.

BEST MODE FOR CARRYING OUT THE INVENTION

Embodiments of the invention will now be illustrated with reference to the drawings.

Figure 1:
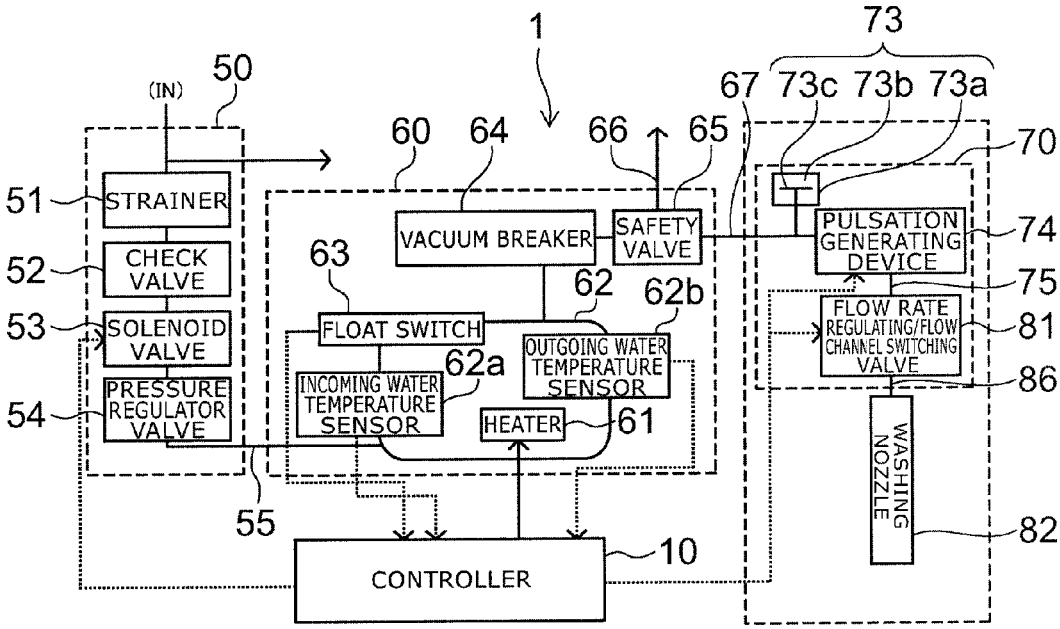
FIG. 1 is a block diagram of the schematic configuration of a sanitary washing device according to a first embodiment, focusing on its water channel system.

FIG. 1 is a block diagram of the schematic configuration of a sanitary washing device according to a first embodiment of the invention, focusing on its water channel system.

As shown in FIG. 1, the water channel system of the sanitary washing device 1 includes a water inlet side valve unit 50 supplied with water from a supply source (not shown) external to the casing of the sanitary washing device 1, a heat exchange unit 60, and a pulsation generating unit (pressurizing device) 70. That is, the water inlet side valve unit 50, the heat exchange unit 60, and the pulsation generating unit 70 are provided in the water channel system of the sanitary washing device 1 sequentially from the side of the supply source (not shown) external to the casing of the sanitary washing device 1.

Wash water imparted with pulsation by the pulsation generating unit 70 is guided from the pulsation generating unit 70 to a washing nozzle 82, and discharged from the nozzle 82. These units are each housed in the casing of the sanitary washing device 1. A solenoid valve 53, an incoming water temperature sensor 62*a*, a heater 61, an outgoing water temperature sensor 62*b*, a float switch 63, a pulsation generating device (pressurizer) 74, a flow rate regulating/flow channel switching valve 81, the washing nozzle 82, and control buttons (not shown) are connected to a controller 10. The control buttons include a washing button for selecting one of the washing modes of "bottom hard wash" with a strong feeling of stimulation, "bottom soft wash" (hereinafter referred to as "gentle wash"), and "bidet wash", a water strength change button for changing the water strength of wash water, a temperature adjustment button by which the temperature of wash water can be selected, and a stop button for stopping washing.

These units are each connected by a supply water conduit across the pulsation generating unit 70. More specifically, the water inlet side valve unit 50 and the heat exchange unit 60 are connected by a supply water conduit 55.

The water inlet side valve unit 50 is directly supplied with wash water (e.g., tap water) from a supply water source (e.g., water pipe). Dust and the like in this wash water guided to the water inlet side valve unit 50 are trapped by a strainer 51 of the water inlet side valve unit 50, and the wash water flows into a check valve 52. When the conduit is opened by the solenoid valve 53, the wash water flows into a pressure regulator valve 54. Then, with the pressure regulated to a predetermined pressure (e.g., a supply water pressure of 0.110 MPa), the wash water flows into the heat exchange unit 60 of the instantaneous heating type. The flow rate of inflow wash water under such pressure regulation is set to approximately 200-600 cc/min. Here, alternatively, the pipe from a flush water tank (not shown) storing flush water for flushing the toilet bowl can be branched to the water inlet side valve unit 50.

The heat exchange unit 60 downstream of the aforementioned water inlet side valve unit 50 includes a heat exchanger 62 with the heater 61 incorporated therein. While this heat exchange unit 60 uses the incoming water temperature sensor 62*a* and the outgoing water temperature sensor 62*b* to detect the temperature of wash water flowing into the heat exchanger 62 and the temperature of wash water flowing out of the heat exchanger 62, the heat exchange unit 60 uses the detected temperature to control the heating operation of the heater 61 so that the wash water is heated to a preset temperature of wash water. That is, in the heat exchange unit 60, heating by the heater 61 is performed so that the temperature of wash water is set to a predetermined preset temperature. Here, the heating operation of the heater 61 is controlled by the controller 10 on the basis of the detected temperature from the incoming water temperature sensor 62*a* and the detected temperature from the outgoing water temperature sensor 62*b* so that the temperature of wash water is set to a predetermined preset temperature.

Then, the wash water thus heated flows into the pulsation generating unit 70 described later, is imparted with pulsation, and then flows into the washing nozzle 82. Here, pulsation means pressure variation caused by the pulsation generating unit, and a device or the like causing pressure variation is referred to as pulsation generating unit. Hence, the pulsation generating device 74 is synonymous with pressurizer. That is, the pulsation generating device 74 can be referred to as a pressurizer for changing the pressure of wash water discharged from the water discharge port.

Furthermore, this heat exchange unit 60 includes the float switch 63 for detecting the water level in the heat exchanger 62. This float switch 63 is configured so as to output a signal indicating that the water level is equal to or higher than a predetermined water level at which the heater 61 is submerged. The controller 10 controls energization of the heater 61 under the situation of monitoring input of this signal. Hence, it is possible to prevent energization of the heater 61 not submerged, that is, the so-called boil-dry of the heater 61.

Here, the heater 61 of the heat exchange unit 60 is optimally controlled by feedforward control and feedback control combined in the controller 10.

Furthermore, this heat exchange unit 60 includes a vacuum breaker 64 and a safety valve 65 at the wash water outlet from the heat exchanger 62, that is, at the junction of the heat exchanger with the conduit downstream of the heat exchanger 62. The vacuum breaker 64 introduces atmospheric air into the conduit under negative pressure to break wash water in the conduit downstream of the heat exchanger and prevent backflow of wash water from the downstream side of the heat exchanger. That is, the vacuum breaker 64 introduces atmospheric air into the conduit under negative pressure so that wash water in the conduit downstream of the heat exchanger is ejected from the washing nozzle 82. Thus, even if the pressure in the conduit is negative, it is possible to prevent backflow of wash water from the downstream side of the heat exchanger to the heat exchanger 62. Furthermore, when the water pressure in a supply water conduit 67 exceeds a predetermined value, the safety valve 65 opens and ejects wash water to a wastewater piping 66, thereby preventing malfunctions such as damage to devices and hose disengagement under abnormal conditions.

Next, the structure of the pulsation generating device 74 is illustrated.

Figure 2:
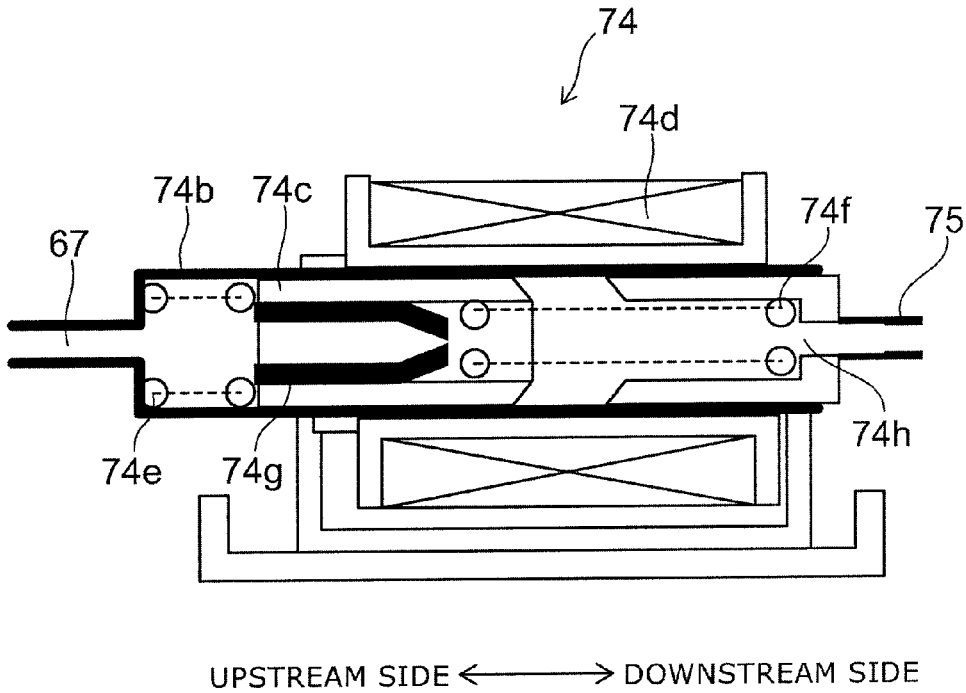
FIG. 2 is a schematic configuration sectional view of the pulsation generating device.

FIG. 2 is a schematic configuration sectional view of the pulsation generating device 74. As described above, the pulsation generating device referred to herein can also be termed as a pressurizer for causing pressure variation.

The pulsation generating device 74 of this embodiment includes one pressurizing section. As shown in FIG. 2, the pulsation generating device 74 includes a cylinder 74*b* connected to the supply water conduits 67, 75, a plunger 74*c* movably provided inside the cylinder 74*b*, a check valve 74*g* provided inside the plunger 74*c*, and a pulsation generating coil 74*d* for moving the plunger 74*c* forward and backward under control of an exciting voltage. The check valve is disposed so that the pressure of wash water increases when the position of the plunger 74*c* is changed to the washing nozzle side (downstream side), and that the pressure of wash water decreases when it is changed to the side (upstream side) opposite to the washing nozzle.

This plunger 74*c* is moved to the upstream or downstream side by controlling the excitation of the pulsation generating coil 74*d*. That is, to add pulsation to wash water (to cause pressure variation in wash water), the plunger 74*c* is moved forward and backward in the axial direction (upstream direction and downstream direction) of the cylinder 74*b* by controlling the exciting voltage passed in the pulsation generating coil 74*d*.

Here, the plunger 74*c* moves from the original position (plunger original position) as shown to a downstream side 74*h* by excitation of the pulsation generating coil 74*d*. Then, when the excitation of the coil is extinguished, it returns to the original position by the biasing force of a return spring 74*f*. Here, a buffer spring 74*e* buffers the return motion of the plunger 74*c*. The plunger 74*c* includes the duckbill check valve 74*g* to prevent backflow to the upstream side. Hence, at the time of motion from the plunger original position to the downstream side, the plunger 74*c* can pressurize wash water in the cylinder 74*b* and drive it to the supply water conduit 75. Here, because the plunger original position and the position after the motion to the downstream side are always the same, the amount of wash water fed to the supply water conduit 75 in response to the motion of the plunger 74*c* is constant.

Subsequently, at the time of return to the original position, wash water flows into the cylinder 74*b* through the check valve 74*g*. Thus, at the next time when the plunger 74*c* moves to the downstream side, a constant amount of wash water is newly fed to the supply water conduit 75.

Here, the pulsation generating device 74 is supplied with the wash water at the aforementioned supply water pressure through the supply water conduit 67. Hence, as described above, the wash water poured into the cylinder 74*b* through the check valve 74*g* during the return of the plunger 74*c* to the original position is fed to the supply water conduit 75, although the primary pressure is not maintained due to the effect of pressure loss caused by the check valve 74*g* and drag-in of wash water on the downstream side. That is, the wash water poured into the cylinder 74*b* through the check valve 74*g* during the return of the plunger 74*c* to the original position flows out toward the supply water conduit 75. Here, the pressure of wash water flowing out to the supply water conduit 75 is different from the primary pressure (the aforementioned supply water pressure) due to the effect of pressure loss caused by the check valve 74*g* and drag-in of wash water on the downstream side.

This situation is shown in the figure.

FIG. 3 is a schematic diagram for illustrating the state of pressure variation of wash water.

As shown in FIG. 3, with the pressure pulsating with reference to the introduced water pressure $P_{in}$ (supply water pressure) for introduction into the pulsation generating device 74, wash water is fed from the pulsation generating device 74 to the supply water conduit 75, and then to the washing nozzle 82, and discharged toward the human body private parts.

Next, a water hammer reduction accumulator 73 is illustrated. The water hammer reduction accumulator 73 includes a housing 73*a*, a damper chamber 73*b* in the housing, and a damper 73*c* placed in this damper chamber.

The water hammer reduction accumulator 73 thus configured reduces, by the action of the damper 73*c*, water hammer applied to the supply water conduit 67 on the upstream side of the pulsation generating unit 70. This can alleviate the effect of water hammer exerted on the wash water temperature distribution in the heat exchanger 62, and stabilize the temperature of wash water. Here, preferably, the water hammer reduction accumulator 73 is placed close to the pulsation generating device 74 or placed integrally with the device 74 from the viewpoint of being able to rapidly and effectively avoid the propagation of pulsation generated in the pulsation generating device 74 to the upstream side. That is, it is preferable that the water hammer reduction accumulator 73 be placed close to the pulsation generating device 74 or that the water hammer reduction accumulator 73 be integrated with the pulsation generating device 74. Then, it is possible to rapidly and effectively suppress the propagation of pulsation generated in the pulsation generating device 74 to the upstream side.

Next, the flow rate regulating/flow channel switching valve 81 is illustrated. The washing nozzle 82 is connected to the flow rate regulating/flow channel switching valve 81 through a supply water conduit 86. The supply destination of wash water fed from the pulsation generating device 74 is switched among flow channels 83, 84, 85 (see FIG. 4) of the washing nozzle 82, and the flow rate thereof is regulated. That is, the flow rate regulating/flow channel switching valve 81 switches the flow channel so that wash water fed from the pulsation generating device 74 is supplied to each of the flow channels 83, 84, 85 provided in the washing nozzle 82. Furthermore, at this time, the flow channel cross-sectional area is adjusted for flow rate regulation.

Next, the washing nozzle 82 is illustrated. FIGS. 4A and 4B show structure views of the washing nozzle. A plurality of the washing flow channels 83, 84, 85 located in the washing nozzle 82 communicate with a water discharge port 401 for bottom wash configured to discharge wash water toward the "bottom" (human body private parts) and a water discharge port 402 for bidet wash, each located near the tip of the washing nozzle. Wash water vortex chambers 301, 302 are provided upstream of the water discharge ports 401, 402 so that wash water passed through the washing flow channels 83, 85 is swirled and discharged from the water discharge ports as swirling flows.

That is, the water discharge port 401 for bottom wash configured to discharge wash water toward the "bottom" (human body private parts) and the water discharge port 402 for bidet wash are provided near the tip of the washing nozzle 82. The wash water vortex chamber 301 is provided on the upstream side of the water discharge port 401 so as to communicate therewith. The wash water vortex chamber 302 is provided on the upstream side of the water discharge port 402 so as to communicate therewith.

The washing flow channel 83 is connected tangentially to the wash water vortex chamber 302 shaped like a cylinder. The washing flow channel 85 is connected tangentially to the wash water vortex chamber 301 shaped like a cylinder. The washing flow channel 84 is connected to the wash water vortex chamber 301 toward its axial center. The wash water passed in the tangential direction swirls along the inner wall of the wash water vortex chamber 301, 302, and the swirled wash water is discharged from the water discharge port 401, 402 as a swirling flow.

Here, the washing flow channel 84 communicates with the upper side of the wash water vortex chamber 301 and communicates with the water discharge port 401. That is, the washing flow channel 83 is connected to the lower portion of the wash water vortex chamber 302. The washing flow channel 84 is connected to the upper portion of the wash water vortex chamber 301, and the washing flow channel 85 is connected to the lower portion of the wash water vortex chamber 301.

The diameter of the water discharge port 401, 402 is in the approximate range from ϕ 0.5 mm to ϕ 1.8 mm, and an optimal diameter is selected depending on the flow rate. For instance, for a flow rate of 430 ml/min, the diameter of the water discharge port 401 for bottom wash is set to approximately ϕ 0.9 mm, and the diameter of the water discharge port 402 for bidet wash is set to approximately ϕ 1.4 mm.

Figure 5:
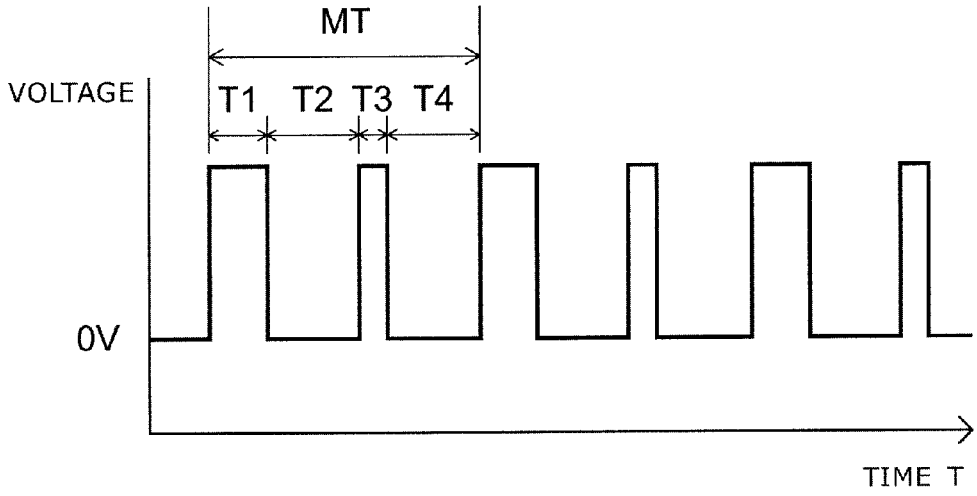
FIG. 5 is a schematic diagram for illustrating a voltage waveform applied to a pulsation generating coil.
Figure 6:
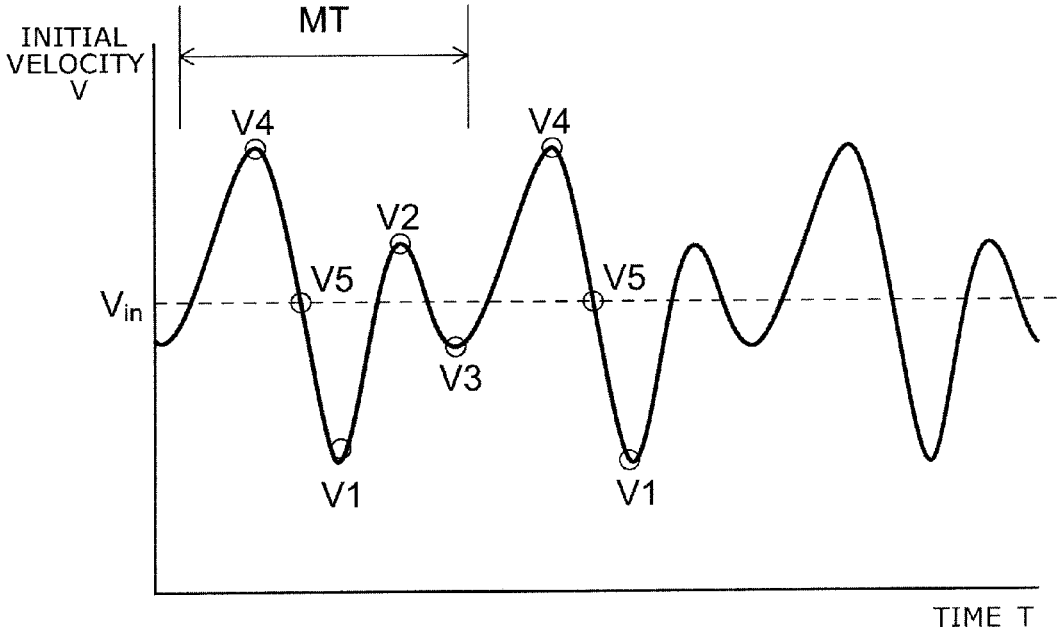
FIG. 6 is a timing chart showing the velocity (initial velocity) of wash water immediately after discharge from a water discharge port.

Here, the state of water discharge of wash water in this embodiment is illustrated. FIG. 5 is a voltage waveform diagram showing the state of excitation of the pulsation generating coil 74*d* of the pulsation generating device 74 for generating pulsation at the time of discharging wash water (a schematic diagram for illustrating the voltage waveform applied to the pulsation generating coil 74*d*), FIG. 6 is a timing chart showing the velocity (initial velocity) of wash water immediately after discharge from the water discharge port, and FIGS. 7A to 7D are views for schematically illustrating the state of wash water discharge from a water discharge port 40.

To excite the pulsation generating coil 74*d* to generate pulsation in the pulsation generating device 74, the controller 10 outputs a pulse-like signal. This pulse signal is outputted to a switching transistor (not shown) connected to the pulsation generating coil 74*d* and configured to turn it on. That is, a switching transistor (not shown) for opening/closing the circuit is connected to the pulsation generating coil 74*d*. The pulse signal outputted from the controller 10 is inputted to the switching transistor.

Hence, the pulsation generating coil 74*d* repeats excitation by turning on/off of the switching transistor in accordance with the pulse signal, and periodically reciprocates (moves forward and backward) the plunger 74*c* as described above. That is, the opening/closing operation (on/off operation) of the switching transistor based on the inputted pulse signal repetitively excites the pulsation generating coil 74*d*. Furthermore, by repetitively exciting the pulsation generating coil 74*d*, the plunger 74*c* is periodically reciprocated (moved forward and backward).

Thus, wash water is supplied from the pulsation generating device 74 to the water discharge port 401 in the state of pulsating flow with the pressure periodically varied up and down, and this pulsating flow of wash water is discharged from each water discharge port.

Here, the pulse-like voltage applied to the pulsation generating coil 74*d* is illustrated in FIG. 5. Furthermore, the timing chart of the velocity (initial velocity) of wash water immediately after discharge from the water discharge port in response thereto is illustrated in FIG. 6. Here, FIG. 6 is a waveform calculated from the formula of velocity $V=C\cdot\Delta P^{1/2}$ (C being a flow rate coefficient) on the basis of the pressure value in FIG. 3.

As seen in FIG. 5, the pulse-like voltage applied to the pulsation generating coil 74*d* of the pulsation generating device 74 has a voltage waveform in which two rectangular waves with different on-times are combined during one cycle. The velocity change of wash water immediately after discharge from the water discharge port caused by this control is illustrated with reference to the motion of the plunger 74*c* of the pulsation generating device 74. The voltage of the voltage waveform shown in FIG. 5 is applied to the pulsation generating coil 74*d* of the pulsation generating device 74.

When the voltage is applied to the pulsation generating coil 74*d* of the pulsation generating device 74 with on-time T1, a current flows. Hence, the pulsation generating coil 74*d* is excited, and the plunger 74*c* is magnetized. Then, if the plunger 74*c* is magnetized, the plunger 74*c* is attracted to the side of the pulsation generating coil 74*d*, that is, to the downstream side.

By this attraction to the downstream side, the return spring 74*f* is compressed to accumulate elastic energy, and simultaneously pressurizes wash water to the highest pressure P4. At this time, the velocity of wash water discharged from the water discharge port 401 is maximized (V4). That is, when the plunger 74*c* is attracted to the downstream side, the return spring 74*f* is compressed, and elastic energy is accumulated therein. Simultaneously, wash water is pressurized by the plunger 74*c*. Here, when the pressure of wash water reaches the highest pressure P4 (see FIG. 3), the velocity of wash water discharged from the water discharge port 401 is maximized (V4 in FIG. 6).

Subsequently, when the voltage is turned off in T2, the excitation of the pulsation generating coil 74*d* is extinguished, and the original position is recovered under the biasing force of the return spring 74*f*. That is, when the application of voltage is stopped with off-time T2, the excitation of the pulsation generating coil 74*d* is canceled. Hence, the plunger 74*c* is returned to the original position by the biasing force of the return spring 74*f*.

Simultaneously, the pressure decreases to the lowest pressure P1 (see FIG. 3). At this time, the velocity of wash water discharged from the water discharge port 401 also decreases to the lowest velocity region V1.

Subsequently, the pressure begins to return to the supply water pressure Pin, and the velocity also begins to return to the velocity Vin at the supply water pressure. At this timing of return, a rectangular wave with on-time T3 shorter than T1 is applied to excite the pulsation generating coil 74*d* and attract the plunger 74*c* to the downstream side, thereby pressurizing the wash water again. That is, at this timing of return, a rectangular-wave voltage with on-time T3 shorter than T1 is applied to the pulsation generating coil 74*d*. Thus, the wash water is pressurized again by exciting the pulsation generating coil 74*d* and attracting the plunger 74*c* to the downstream side.

Here, because the pressure is on the way of return and T3 has shorter time than T1, the wash water does not rise to the highest pressure P4, but reaches a second peak pressure P2 higher than the supply water pressure. Hence, the velocity also exhibits a second peak velocity V2 faster than the velocity at the supply water pressure. Furthermore, a certain period of time for water discharge near the velocity Vin at the incoming water pressure occurs between the second peak velocity V2 and a velocity V3 at the timing when the plunger is excited again.

Here, the timing for the voltage waveform applied to the pulsation generating coil 74*d* is set so that the frequency of pulsation is 50 Hz, T1 is 4.8 msec (milliseconds), T2 is 7 msec, T3 is 1 msec, and T4 is 7.2 msec. That is, the frequency of pulsation is 50 Hz, the on-time T1 is 4.8 msec, the off-time T2 is 7 msec, the on-time T3 is 1 msec, and the off-time T4 is 7.2 msec. However, the frequency and the time span of T1, T2, T3, T4 are not limited thereto. The frequency may be any repetition frequency in the dead band frequency region of 5 Hz or more, and the time span of T1, T2, T3, T4 may be set on the basis of the frequency (pulsation cycle MT). Here, the dead band frequency is a frequency higher than frequencies which a human being can recognize as change of stimulation, that is, a frequency which a human being cannot perceive as intentional repetition of water discharge.

Next, the state of wash water obtained from the velocity waveform produced as described above is illustrated.

FIGS. 7A to 7D are schematic views for illustrating the process in which a pulsating flow of wash water discharged from the hypothetical water discharge port 40 is amplified.

Here, the relationship between pressure variation and velocity change is illustrated with reference to FIGS. 3 and 6. When the pulsation generating device 74 causes the pressure to pulsate, the velocity V also varies and pulsates likewise. That is, in the discharged wash water, when the pressure variation reaches Pmax, the velocity also reaches the maximum velocity Vmax. Thus, the instantaneous velocity varies with time. Each of the sites P1, P2, P3, P4, P5 in the pressure waveform of the pulsating flow of wash water in FIG. 3 corresponds to the velocity V1, V2, V3, V4, V5 in FIG. 6 with the same number.

Figure 7A:
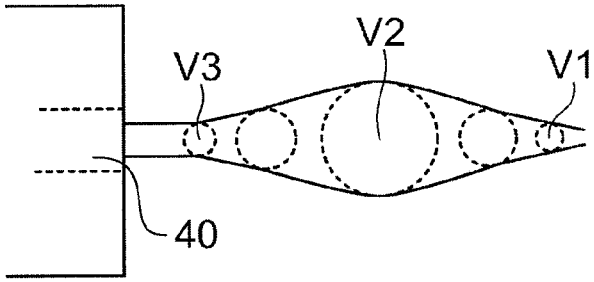
FIGS. 7A to 7D are views for schematically illustrating the state of wash water discharge from the water discharge port.
Figure 7B:
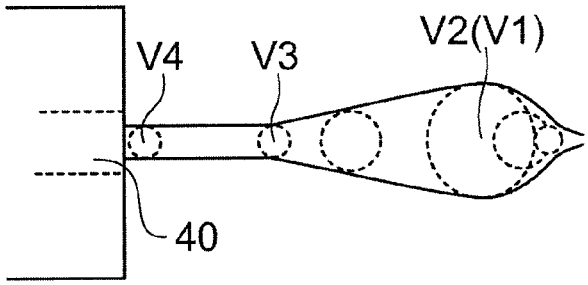

Hence, with the transition from immediately after water discharge to FIGS. 7A-7D, because the velocity V2 is faster than the velocity V1, the wash water discharged with the velocity V1 is overtaken by the wash water discharged with the velocity V2 and wash water existing therebetween to form a water discharge group having a large water discharge cross-sectional area (see FIG. 7B).

Thus, in the up-gradient portion of the velocity waveform, the wash water discharged with a fast velocity successively unites with the wash water discharged previously with a slow velocity to form a large drop (water discharge group) and impinge on the human body private parts (washing surface). Here, as shown in FIGS. 7A and 7B, in the up-gradient portion of velocity in the slower velocity region, because the overall velocity is slow, V2 can unite with V1 to produce a water discharge group having a large water discharge cross-sectional area before impinging on the human body private parts.

That is, in the up-gradient portion of velocity (first water discharge process) between the velocity V1 and the velocity V2 (in the first time span), the overall velocity is slow. Hence, before the wash water discharged with the velocity V1 impinges on the human body private parts, the wash water discharged with the velocity V2 can overtake the wash water discharged with the velocity V1. Consequently, before impinging on the human body private parts, the wash water discharged with the velocity V2 can unite with the wash water discharged with the velocity V1 to produce a water discharge group (first water drop) having a large water discharge cross-sectional area.

This wash water (water discharge group having a large water discharge cross-sectional area) is in the state of having a large cross-sectional area of impingement (feeling of volume) when impinging on the human body private parts.

Figure 7C:
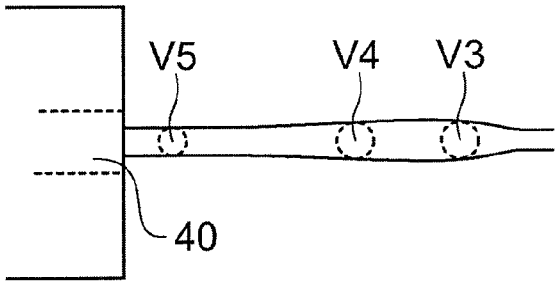
Figure 7D:
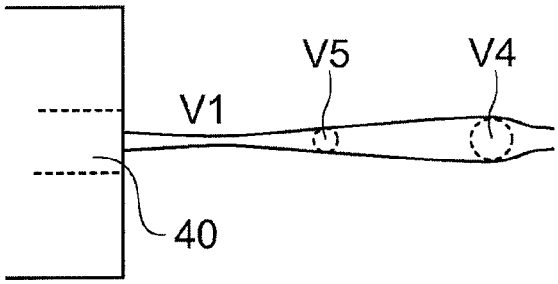

On the other hand, as shown in FIGS. 7C and 7D, at V3 and V4 on the velocity up-gradient in the faster velocity region, because the overall velocity is fast, the distance is less likely to decrease in the short time until impingement of water on the human body private parts. Hence, at the time of impingement of water on the human body private parts, V4 impinges as a fast water discharge group having a small water discharge cross-sectional area without substantially uniting with V3.

That is, in the up-gradient portion of velocity (second water discharge process) between the velocity V3 and the velocity V4 (in the second time span), the overall velocity is fast. Hence, before the wash water discharged with the velocity V3 impinges on the human body private parts, the wash water discharged with the velocity V4 is less likely to overtake the wash water discharged with the velocity V3. Consequently, before impinging on the human body private parts, the wash water discharged with the velocity V3 and the wash water discharged with the velocity V4 scarcely unite with each other and each result in impinging as a water discharge group (second water drop) having a small water discharge cross-sectional area. This wash water (water discharge group having a small water discharge cross-sectional area) is in the state of having a large velocity component in collision energy (feeling of stimulation) when impinging on the human body private parts.

Furthermore, at this time, by controlling so as to provide a sufficient interval between the timings of V2 and V4, in other words, to produce peaks at V2 and V4, a sufficient time interval occurs, when V4 is discharged, between the water discharge group generated by V2 and the water discharge group generated by V4.

That is, by providing the off-time T4 (waiting time), a sufficient time interval can be provided between the wash water discharged with the velocity V2 and the wash water discharged with the velocity V4.

Consequently, the water discharge group generated with the velocity V2, having a large water discharge cross-sectional area, and having a slower velocity than the velocity V4, and the water discharge group generated with the velocity V4, having a small water discharge cross-sectional area, and having a fast velocity, can independently impinge on the human body private parts with different velocities.

Furthermore, at the timing of transition from the velocity V4 to the velocity V1, the velocity is decelerated. Thus, no water discharge group is generated by union, and this region does not contribute to the washing feeling. Hence, reduction of this region leads also to enhancing the washing feeling.

The water discharge group referred to herein is one in which the cross-sectional area cut perpendicularly to the traveling direction of wash water discharged from the water discharge port is larger than the cross-sectional area immediately after discharge from the water discharge port due to overtaking after discharge. That is, the water discharge group refers to one in which the water discharge cross-sectional area (the cross-sectional area cut perpendicularly to the traveling direction of wash water) is larger than the water discharge cross-sectional area immediately after discharge due to overtaking of the wash water discharged subsequently.

Here, if the water discharge cross-sectional area increases and results in a water discharge group with a different water discharge cross-sectional area due to overtaking of wash water after discharge, the load when impinging on the human body private parts is larger than that of the discharged water without increase in water discharge cross-sectional area (without formation of the water discharge group).

Figure 8:
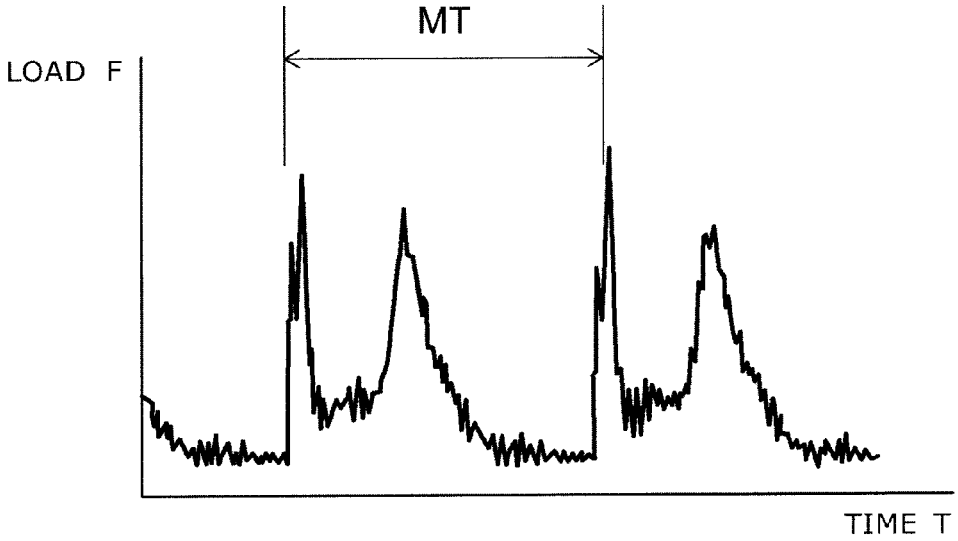
FIG. 8 is a timing chart showing the change of load in response to discharged water impinging on human body private parts.

FIG. 8 is a timing chart showing the change of load in response to discharged water impinging on the human body private parts in this example. As seen in this figure, during one cycle (pulsation cycle MT), the load increases at two timings. Thus, it turns out that during one cycle, two water discharge groups are formed and impinge independently.

In the case illustrated in FIG. 8, a water discharge group having a large water discharge cross-sectional area and a slow velocity impinges earlier, and a water discharge group having a small water discharge cross-sectional area and a fast velocity impinges later. Hence, the user can independently feel two water discharge groups different in velocity and size. In this case, the user can feel the feeling of volume by the large and slow water discharge group, and the feeling of stimulation by the small and fast water discharge group.

With regard to this change of load, the value obtained by integrating the "peak portion" is M·V, or impact. If this value is sufficiently large, a "feeling of impingement" can be obtained. The water discharge group referred to here is one impinging on the human body private parts with a certain impact.

Here, in the wash water discharged as a pulsating flow, with regard to the velocity waveform in this case, a slow and large water discharge group with the velocity V2 and a fast and small water discharge group with the velocity V4 each occur at intervals of the pulsation cycle MT. Hence, the slow and large water discharge group and the fast and small water discharge group occur alternately. That is, water discharge groups occur at intervals of half the pulsation cycle MT. Hence, even for a long cycle (pulsation cycle MT), a comfortable washing feeling with more continuous feeling can be obtained, and more comfortable washing can be provided even to those who dislike an intermittent feeling. Furthermore, in each of these water discharge groups, the wash waters discharged later with the velocity V5 and the velocity V1 are concatenated with the wash water discharged with the velocity V4.

Next, the effect achieved by these states of water discharge is illustrated. Here, an illustration is given of the process in which a water discharge group having a large water discharge cross-sectional area is generated on the slow velocity side. The water discharge group is generated in the process in which the wash water discharged with a fast velocity overtakes the wash water discharged with a slow velocity during the time interval from when the wash water is discharged from the water discharge port 40 until impinging on the human body private parts.

Here, if a water discharge group is generated in the fast velocity region, the time for traveling from the water discharge port 40 to the human body private parts is short. For instance, for a velocity of 15 m/sec, the time to reach the human body private parts at 60 mm ahead is 4 msec. On the other hand, in the case of the slow velocity region, the time for traveling from the water discharge port 40 to the human body private parts is longer than in the case of the fast velocity region. For instance, for a velocity of 7.5 m/sec, the time to reach the human body private parts is 8 msec. Here, for the same amount of velocity difference, the amount of wash water which can overtake is larger when the time to reach the human body private parts is longer. That is, it is possible to efficiently generate a water discharge group having a larger water discharge cross-sectional area when the water discharge group is generated on the lower side of wash water velocity.

Because the water discharge group thus generated is a water discharge group having a larger water discharge cross-sectional area, the water discharge cross-sectional area S is larger than normal. Hence, despite the small amount of wash water, a discharged water having a large water discharge cross-sectional area impinges, and there is a washing feeling just like being washed with a high flow rate, or the feeling of volume. That is, by causing a water discharge group having a large water discharge cross-sectional area to impinge, a washing feeling just like being washed with a high flow rate, or the feeling of volume, can be achieved even if the amount of wash water actually used is decreased.

On the other hand, the water discharge group having a small water discharge cross-sectional area and a fast velocity can scarcely overtake the wash water discharged earlier with the fast velocity V4, and impinges on the human body private parts before forming a water discharge group having a large water discharge cross-sectional area, resulting in a small water discharge cross-sectional area and a poor feeling of volume. However, not overtaking the wash water discharged earlier makes it possible to impinge on the human body private parts without absorption of kinetic energy by the wash water with a slow velocity, hence enabling impingement of water with the feeling of stimulation maintained.

Because of the high velocity, the impact associated with the feeling of stimulation at this time also increases. That is, although the feeling of volume decreases, the feeling of stimulation can be increased. Hence, by developing the feeling of volume with a large and slow water discharge group and developing the feeling of stimulation with a small and fast water discharge group, it is possible to realize highly comfortable washing establishing compatibility between the feeling of volume and the feeling of stimulation.

Here, the large and slow water discharge group and the small and fast water discharge group each have a sufficient impact. Hence, pulsation can be felt at intervals of half the pulsation cycle MT. This feeling is sufficiently shorter than the feeling which can be distinguished by a human being. Hence, the feeling of stimulation and the feeling of volume can be realized in combination with the continuous washing feeling.

Next, the phenomenon of generating the water discharge group is illustrated.

Figure 9:
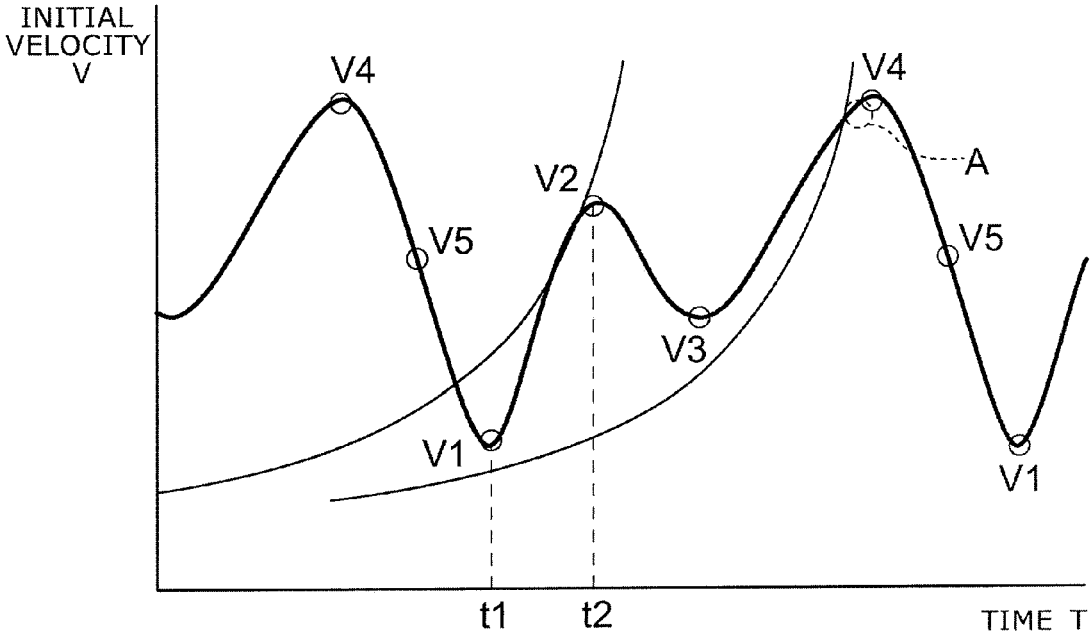
FIG. 9 is a timing chart showing the velocity (initial velocity) waveform and the overtaking curve.

FIG. 9 is a timing chart showing the velocity (initial velocity) waveform and the overtaking curve. First, the overtaking curve is illustrated. The overtaking curve indicates that wash waters, even different in the timing of water discharge and the velocity of water discharge, impinge simultaneously on the human body private parts at 60 mm ahead as long as they are located on this curve. That is, the overtaking curve is a hypothetical curve for indicating the relationship between velocity and water discharge timing for simultaneous impingement of water on the impinging position at a predetermined distance (which is set to 60 mm in this embodiment).

The wash water with a slower velocity than this overtaking curve is overtaken by the succeeding wash water with a faster velocity, and they unite with each other and impinge simultaneously on the human body private parts. Hence, on the velocity waveform, if the overtaking curve is superimposed with the reference point set to the velocity V2 (i.e., if the overtaking curve determined with reference to the velocity V2 is superimposed), the region of velocity slower than this overtaking curve is entirely overtaken by the wash water having the velocity V2, and a water discharge group with the volume given by the integrated value is generated and impinges on the human body private parts. This results in a large water discharge group, with the velocity of the water discharge group being 12 m/sec and the amount of the water discharge group being 21 microliters.

On the other hand, in the velocity waveform on and around the overtaking curve drawn with the reference point set to V4 (i.e., the overtaking curve determined with reference to the velocity V4), the gradient is more gradual than the overtaking curve, and the slower region "A" (the slope portion on the right side) is very small. In this case, although the amount of the water discharge group is small, the overtaking amount is small accordingly, and hence there is no slowdown due to absorption of velocity by a slower velocity. That is, although the amount of wash water of the water discharge group is small, it is less likely that the kinetic energy of the wash water having a fast velocity is absorbed by the wash water having a slow velocity. In other words, a fast water discharge group, although with a small water discharge cross-sectional area, is generated.

In this case, the velocity of the water discharge group is 14 m/sec, and the amount of wash water thereof is 6 microliters. Thus, it impinges on the human body private parts without attenuation of the feeling of stimulation. Thus, for a water discharge group having a large water discharge cross-sectional area, because of the large amount of wash water, it is possible to provide the same feeling as in the case of washing with a large amount of water. Furthermore, for a water discharge group having a small water discharge cross-sectional area and a fast velocity, because it impinges on the human body private parts without deceleration, the feeling of stimulation can be felt. Moreover, by causing this water discharge group (the water discharge group having a small water discharge cross-sectional area and a fast velocity) to impinge on the human body private parts with a fast frequency, the feeling of stimulation and the feeling of volume can be felt simultaneously.

Here, the water discharge cross-sectional area is approximately 12.6 $mm^2$ for the large water discharge group and 3.8 $mm^2$ for the small water discharge group. Hence, the water discharge cross-sectional area is different therebetween. Thus, by generating water discharge groups being relatively different in the water discharge cross-sectional area of the water discharge group generated by overtaking, water discharge groups different in the feeling of stimulation and the feeling of volume are generated and caused to impinge separately, achieving compatibility between the feeling of stimulation and the feeling of volume.

Here, a water discharge group occurs if the water discharge cross-sectional area is approximately larger than that converted from the diameter of the water discharge port by overtaking of wash water. Furthermore, if water discharge groups being relatively different in the water discharge cross-sectional area of the water discharge group generated by overtaking are generated at the location of impinging on the human body private parts, then it is regarded as generation of different water discharge groups. That is, if water discharge groups being relatively different in water discharge cross-sectional area are generated by overtaking of wash water discharged later until impinging on the human body private parts, then it is regarded as generation of different water discharge groups.

Furthermore, the feeling of stimulation and the feeling of volume can be produced simultaneously by causing each water discharge group to impinge at least once in the dead band frequency region of 5 Hz or more. That is, the pulsation frequency only needs to be 5 Hz or more.

Next, the washing feeling in this embodiment is illustrated.

The inventors thought that the washing feeling is represented by the feeling of stimulation and the feeling of volume, which depend on the impact M·V of discharged water.

Here, the feeling of stimulation is a feeling in which stimulation similar to pain is felt by impingement of a fast discharged water on the human body private parts, and depends on the velocity V.

On the other hand, the feeling of volume is a feeling in which impingement of a thick water flow is felt by impingement of discharged water having a large water discharge cross-sectional area S (weight M) with a sufficient strength. The larger the impinging area of discharged water, the more the feeling of volume is felt. Comfortable washing can be realized by satisfying all these physical quantities.

However, from the viewpoint of energy saving, the amount of wash water is 500 ml/min or less in hot water generation by instantaneous heat exchangers in the current mainstream. Hence, it is difficult to satisfy all these physical quantities. Thus, generation of the water discharge group has been investigated to satisfy all these physical quantities.

FIG. 10 shows an example of the velocity waveform of pulsating transition and the shape of generated water discharge groups. Here, the relationship is illustrative, and they are not necessarily generated in this relationship depending on the velocity region and the like. The fast water discharge group [I] is a water discharge group in which the amount of overtaking is decreased by causing the velocity up-gradient to be more gradual than the gradient of the overtaking curve. Although the velocity is fast, the amount of wash water is small. That is, a water discharge group with the feeling of stimulation but low in the feeling of volume is generated.

The large water discharge group [II] is a water discharge group gradually collected by overtaking by causing the velocity up-gradient to be close to the gradient of the overtaking curve. In this case, because the velocity is decelerated, the feeling of stimulation is limited. However, a water discharge group with a large amount of wash water and a large impact is generated.

The scattered water discharge group [III] is a water discharge group in which by causing the velocity up-gradient to be steeper than the gradient of the overtaking curve, overtaking is caused with a large velocity difference between the slow velocity and the fast velocity to scatter the discharged water so that the discharged water with the fast velocity shoots the preceding discharged water with the slow velocity. In this case, because the apparent water discharge cross-sectional area increases, a water discharge group with a high feeling of volume is generated. Thus, by generation of different pulsating flows, it is possible to generate discharged waters with different characteristics in different kinds of water discharge groups.

That is, by different pulsating flows, water discharge groups having different shapes and characteristics can be generated. However, on the other hand, one of the physical quantities related to the feeling of stimulation and the feeling of volume has been lacking.

Thus, these different kinds of water discharge groups are each caused to impinge on the human body private parts at least once in the dead band frequency region of approximately 5 Hz or more in which the human perception cannot follow the oscillation based on intentional repetition of water discharge. Then, each discharged water, which independently produces its own physical quantity and feeling, impinges in the dead band frequency region. Hence, it can produce a feeling as a discharged water with all the physical quantities, that is, with the feeling of stimulation and the feeling of volume.

That is, different water discharge groups are each caused to impinge on the human body private parts at least once in the dead band frequency region of approximately 5 Hz or more which a human being cannot perceive as intentional repetition of water discharge. In this case, each of the different water discharge groups independently produces its own physical quantity and feeling, but the different water discharge groups impinge in the dead band frequency region. Hence, it can produce a feeling of water discharge with all the physical quantities, that is, with the feeling of stimulation and the feeling of volume.

As described above, the size, the velocity, and the amount of overtaking of the water discharge group are changed to form water discharge groups with different physical quantities and generate water discharge groups with different feelings. Furthermore, such water discharge groups are caused to independently impinge on the human body private parts in a short period of time, thereby realizing water discharge with a plurality of feelings.

Figure 11:
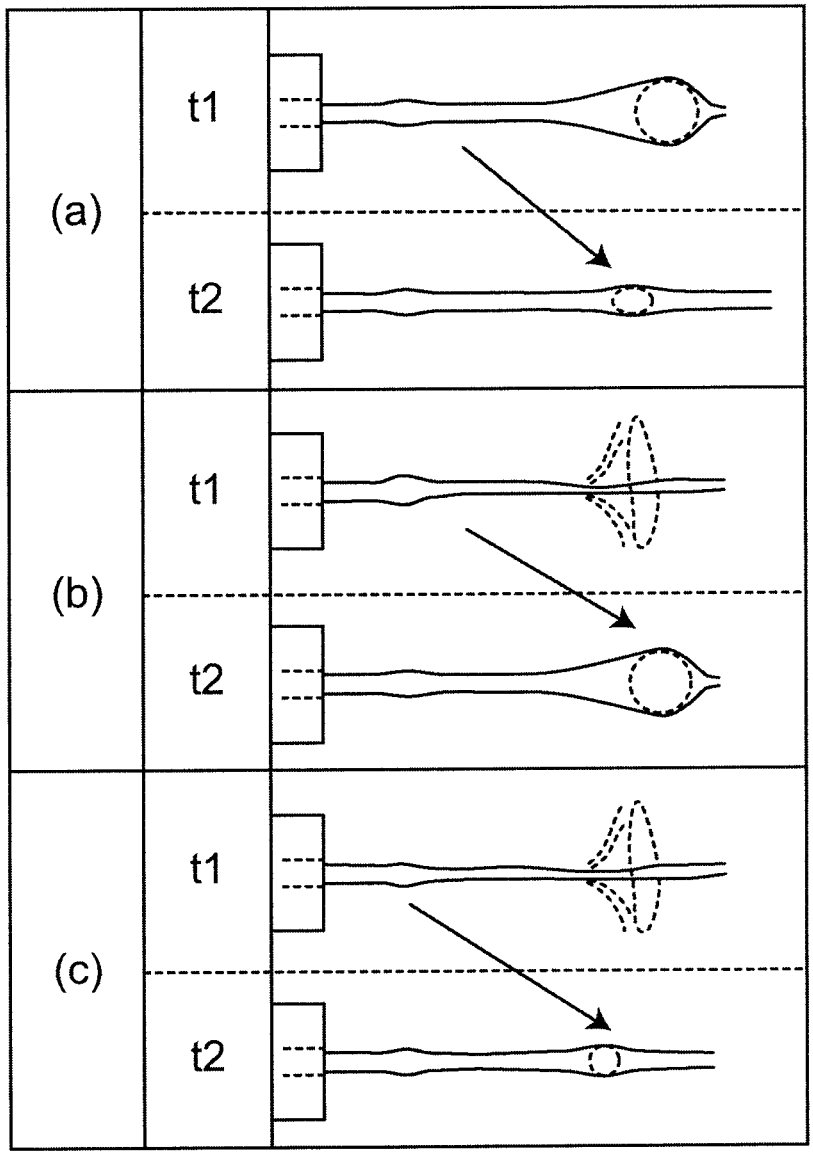
FIGS. 11A to 11C are schematic views for illustrating of a combination of water discharge groups.

Here, an example of such combination is illustrated. FIG. 11 shows a schematic view of an example combination of water discharge groups. FIG. 11A shows the situation of alternate generation of a "large water discharge group" at time t1 and a "fast water discharge group" at time t2, which are caused to independently impinge on the human body private parts.

In such water discharge, first, a "large water discharge group" is generated by increasing the amount of overtaking of the discharged water. In this case (the case of t1 in FIG. 11A), the portion with a fast velocity is attenuated due to overtaking, and the velocity slows down, resulting in a poor feeling of stimulation. However, the size of the water discharge cross-sectional area of the water discharge group increases to a certain area, with the impact increased. Hence, the feeling of volume can be produced.

In the case of t2 in FIG. 11A for the "fast water discharge group", by decreasing the amount of overtaking from behind, the size of the water discharge cross-sectional area of the water discharge group is small. However, because of no deceleration of the velocity of the discharged water, the discharged water can maintain the feeling of stimulation. Hence, the feeling of stimulation can be produced.

These two kinds of water discharge groups are each caused to impinge at least once in the dead band frequency region (5 Hz or more) so that they can be felt as a discharged water with both the feeling of stimulation and the feeling of volume.

FIG. 11B shows a situation in which a "scattered water discharge group" and a "large water discharge group" are alternately generated. In this case, a very high feeling of volume is achieved by the "scattered water discharge group". Furthermore, the "large water discharge group" with a large amount of overtaking is generated subsequently. Hence, a water discharge group with a sufficient impact can be caused to impinge on the human body private parts. Thus, because of the volume and a certain velocity, the feeling of weight of discharged water can be produced. In this case, the "large water discharge group" impinges on the human body private parts with a faster velocity than the "scattered water discharge group", and hence the discharged water provides more feeling of stimulation than the "scattered water discharge group". Thus, the "scattered water discharge group" and the "large water discharge group" can also produce a feeling of discharged water having both the feeling of stimulation and the feeling of volume.

FIG. 11C shows a situation in which a scattered water discharge group and a fast water discharge group are alternately generated. In combination with achieving the feeling of volume with the scattered water discharge group, the feeling of stimulation can be produced with the fast water discharge group. Here, these water discharge groups may be generated as a combination of the three, and thereby a water discharge with a very high feeling of volume and the feeling of stimulation can be realized.

That is, the water discharge group is not limited to the configurations illustrated in FIG. 7, but may have the configurations illustrated in FIGS. 11A to 11C. Furthermore, the water discharge group may be formed by combining the three configurations illustrated in FIGS. 11A to 11C. By combining water discharge groups with different physical quantities, including the "fast water discharge group", the "large water discharge group", and the "scattered water discharge group", it is possible to produce water discharge with a very high feeling of volume and feeling of stimulation.

Here, the sequence in which the water discharge groups are formed may be other than those illustrated, and may change every time. Furthermore, the timing at which the water discharge group impinges on the human body private parts does not necessarily need to be regular, but the interval may vary. In this case, for instance, a table of frequencies with different pulsating cycles is prepared in advance, and the frequency may be varied in the dead band frequency region. Furthermore, it may be varied randomly in the dead band frequency region. Moreover, pulsation may be generated sporadically.

Thus, in this embodiment, different feelings are generated by different water discharge groups, and a plurality of water discharge groups are caused to impinge in the dead band frequency region so that a different feeling can be generated by each water discharge group. That is, water discharge groups with different physical quantities are formed, and a plurality of water discharge groups are caused to separately impinge on the human body private parts in the dead band frequency region so that a different feeling can be produced by each water discharge group.

These are an example of water discharge groups, and the combinations are also merely an example. Here, the point is that different feelings are produced by different water discharge groups to compensate for missing feelings and physical quantities, thereby realizing a high washing feeling. That is, it is only necessary to produce different feelings by different water discharge groups to compensate for missing feelings and physical quantities so that a high washing feeling can be produced.

FIG. 12 is a graph for illustrating the state of pressure variation of wash water.

Figure 12A:
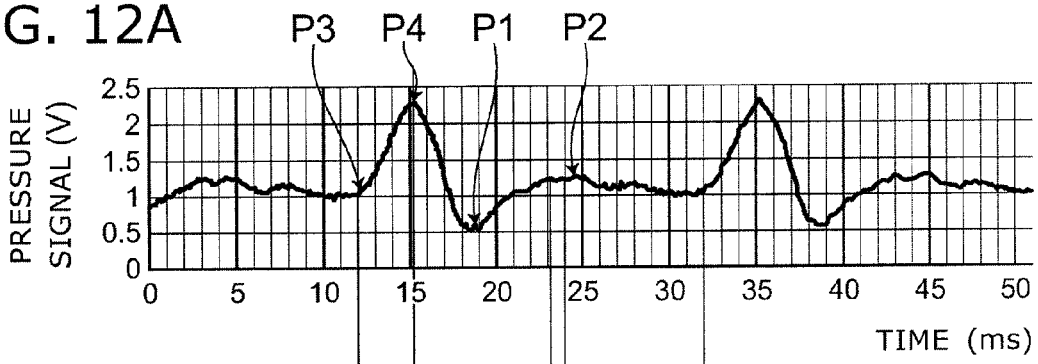
FIG. 12A is a graph showing a measurement example of the pressure waveform of wash water.
Figure 12B:
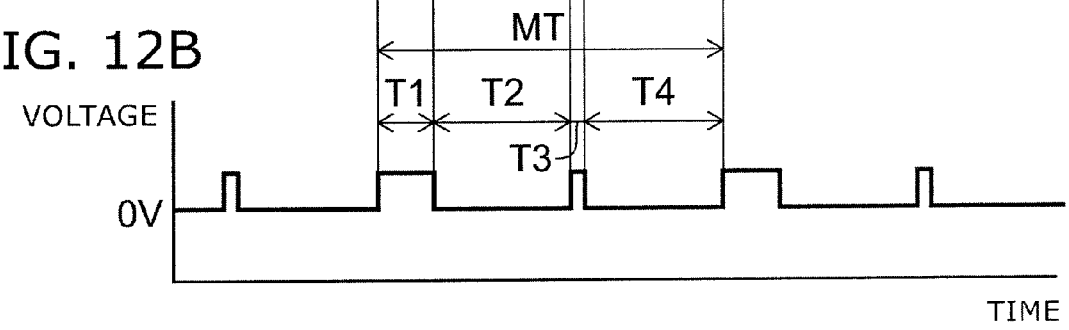
FIG. 12B is a graph showing an example of the waveform of a pulse-like voltage applied to the pulsation generating coil.

Here, FIG. 12A corresponds to FIG. 3, and is an actual measurement of the pressure waveform. In this case, the pressure of wash water was measured in the wash water vortex chamber 301 communicating with the water discharge port 401. That is, in this specification, the "pressure of wash water" refers to the pressure of wash water in the flow channel (flow channel inner pressure) on the downstream side of the pressurizing device, and is illustratively obtained by measuring the pressure of wash water in the water discharge port 401 or 402, or the wash water vortex chamber 301 or 302 communicating therewith, that is, measuring the pressure of wash water immediately before being discharged from the washing nozzle 82. Furthermore, a pressure gauge with high responsivity was used to perform measurement at high sampling rate. FIG. 12B corresponds to FIG. 5, and shows the waveform of a pulse-like voltage applied to the pulsation generating coil 74*d*.

Figure 13:
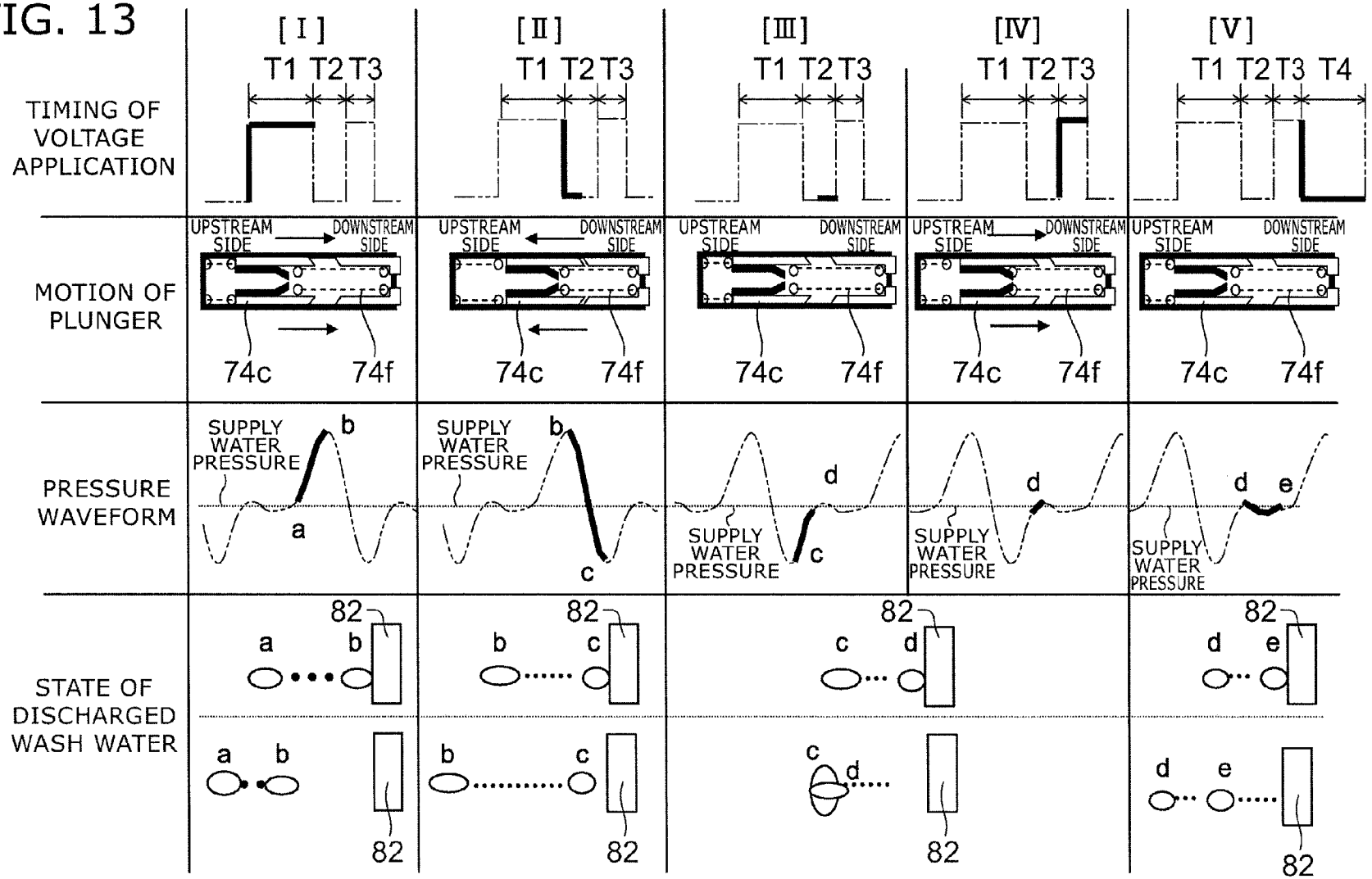
FIG. 13 is a schematic diagram for illustrating the timing of voltage application, the motion of the plunger, the pressure waveform, and the state of discharged wash water.

FIG. 13 is a schematic diagram for illustrating the timing of voltage application, the motion of the plunger, the pressure waveform, and the state of discharged wash water. Here, in the "state of discharged wash water" section, the figure in the upper field shows the state immediately after water discharge, and the figure in the lower field shows the state immediately before impingement of water on the human body private parts. Furthermore, a, b, c, d, e in the figure represent wash water discharged under pressure a, b, c, d, e, respectively.

As shown in FIG. 13 [I], a high pressure region is formed by active pressurization from the neighborhood of the supply water pressure so that a "water discharge group having a small water discharge cross-sectional area and a fast velocity" is generated in the high pressure region. Because the velocity can be accelerated in the high pressure region, the time to reach the human body private parts can be reduced. This suppresses the situation in which the wash water discharged later overtakes the wash water discharged earlier. This consequently facilitates generating a "water discharge group having a small water discharge cross-sectional area and a fast velocity".

In this case, when the voltage is applied to the pulsation generating coil 74*d*, not shown, with on-time T1, a current flows in the pulsation generating coil 74*d*. Hence, the pulsation generating coil 74*d* is excited, and the plunger 74*c* is magnetized. Then, if the plunger 74*c* is magnetized, the plunger 74*c* is attracted to the side of the pulsation generating coil 74*d*, that is, to the downstream side. By this attraction to the downstream side, the wash water is pressurized, and the pressure increases from the pressure around the supply water pressure a (e.g., approximately 0.110 MPa) to the highest pressure b.

That is, as shown in FIG. 12, when the voltage is applied to the pulsation generating coil 74*d* with on-time T1, the pressure of wash water increases from the pressure P3 around the supply water pressure to the highest pressure P4. At this time, as the pressure varies, the velocity also varies correspondingly.

Here, as described above, in the up-gradient portion of velocity between the velocity V3 corresponding to the pressure P3 (pressure a) and the velocity V4 corresponding to the pressure P4 (pressure b), the overall velocity is fast.

Hence, as shown in the "state of discharged wash water" section in FIG. 13 [I], the wash water b discharged later with the velocity V4 is less likely to overtake the wash water a discharged earlier with the velocity V3. Consequently, the wash water a discharged with the velocity V3 and the wash water b discharged with the velocity V4 scarcely unite with each other and result in impinging on the human body private parts as water discharge groups having a small water discharge cross-sectional area. In this case, because the velocity V3 and the velocity V4 are fast, a water discharge group having a small water discharge cross-sectional area and a fast velocity is generated.

As shown in FIG. 13 [II], when the voltage application is stopped after the on-time T1, the plunger 74*c* returns to the original position by the biasing force of the return spring 74*f*. Hence, the pressure of wash water decreases from the pressure b to the pressure c.

In this case, the velocity of wash water discharged earlier under the pressure b is faster than the velocity of wash water discharged later under the pressure c.

Hence, as shown in the "state of discharged wash water" section in FIG. 13 [II], the wash water discharged later cannot overtake and results in individually impinging on the human body private parts. In this case, the velocity and amount of wash water are smaller than in the case of FIG. 13 [I]. This decreases the contribution to increasing the feeling of stimulation and the feeling of volume.

As shown in FIG. 13 [III], when in the region of pressure lower than the supply water pressure, generation of a "water discharge group having a large water discharge cross-sectional area and a slow velocity" is started. That is, water discharge is started at the pressure c.

In this case, as illustrated in FIG. 13 [II], when the plunger 74*c* returns to the original position by the biasing force of the return spring 74*f*, the wash water is dragged in, and thus the pressure c becomes lower than the supply water pressure. Hence, a region of pressure lower than the supply water pressure can be easily formed. In the region of pressure lower than the supply water pressure, the velocity can be slowed down, and thus the time to reach the human body private parts can be prolonged. Hence, it is possible to increase the amount of wash water discharged later overtaking the wash water discharged earlier, which facilitates generating a "water discharge group having a large water discharge cross-sectional area and a slow velocity".

Furthermore, as shown in FIG. 13 [IV], in the second half of the process for generating the "water discharge group having a large water discharge cross-sectional area and a slow velocity", the voltage is applied to the pulsation generating coil 74*d* with on-time T3. Also in the case of applying voltage to the pulsation generating coil 74*d* with on-time T3, by attraction of the plunger 74*c*, the wash water is pressurized, and the pressure increases. However, because the pressure is on the way of return and the time of T3 is shorter than T1, the pressure does not increase to the pressure b, but increases to a pressure d, which is a second peak slightly higher than the supply water pressure.

That is, as shown in FIG. 12, when the voltage is applied to the pulsation generating coil 74*d* with on-time T3, the pressure of wash water does not increase to the pressure P4, but increases to the pressure P2, which is a second peak slightly higher than the supply water pressure.

Here, as described above, in the up-gradient portion of velocity between the velocity V1 corresponding to the pressure P1 (pressure c) and the velocity V2 corresponding to the pressure P2 (pressure d), the overall velocity is slow. Furthermore, the velocity V2 is faster than the velocity V1.

Hence, as shown in the "state of discharged wash water" section in FIG. 13 [III], [IV], the wash water d discharged later with the velocity V2 can overtake the wash water c discharged earlier with the velocity V1. Consequently, the wash water c discharged with the velocity V1 and the wash water d discharged with the velocity V2 unite with each other to produce a water discharge group having a large water discharge cross-sectional area. In this case, the velocity V1 and the velocity V2 are slower than the velocity V3 and the velocity V4. Hence, a water discharge group having a large water discharge cross-sectional area and a slow velocity is generated.

Next, as shown in FIG. 13 [V], when the voltage application is stopped after the on-time T3, the plunger 74*c* returns to the original position by the biasing force of the return spring 74*f*. In this case, because the amount of attraction of the plunger 74*c* in the on-time T3 is small, the amount of motion by the biasing force of the return spring 74*f* is also small. Hence, a state like coming to rest around the original position is realized.

As described above, the pressure d is slightly higher than the supply water pressure, and the pressure e is approximately the supply water pressure. Hence, in this region, the pressure is maintained around the supply water pressure.

In this case, the velocity of the wash water d discharged earlier under the pressure d is nearly equal to the velocity of the wash water e discharged later under the pressure e.

Hence, as shown in the "state of discharged wash water" section in FIG. 13 [V], the velocity of the wash water e discharged later cannot overtake and results in individually impinging on the human body private parts.

Here, by providing off-time T4, a sufficient time interval can be provided between the wash water c-d and the wash water a-b. Hence, the "water discharge group having a large water discharge cross-sectional area and a slow velocity" generated by the wash water c-d and the "water discharge group having a small water discharge cross-sectional area and a fast velocity" generated by the wash water a-b can be caused to independently impinge on the human body private parts with different velocities without mutual interference.

This leads to producing different water discharge groups at uniform time intervals in one cycle. Hence, it is possible to realize comfortable washing with little intermittent feeling even at a frequency lower than the dead band frequency region. Furthermore, by causing each impingement of water in the dead band frequency region, it is also possible to produce the feeling of discharged water with the feeling of stimulation and the feeling of volume.

Furthermore, by further increasing the pressure b (pressure P4) by active pressurization from the neighborhood of the supply water pressure, the pressure c (pressure P1) formed subsequently can be further decreased. This can facilitate forming the aforementioned "region of pressure lower than the supply water pressure".

Furthermore, by active pressurization at the time of return of pressure to the supply water pressure, it is possible to rapidly and stably obtain the pressure around the supply water pressure.

Figure 14:
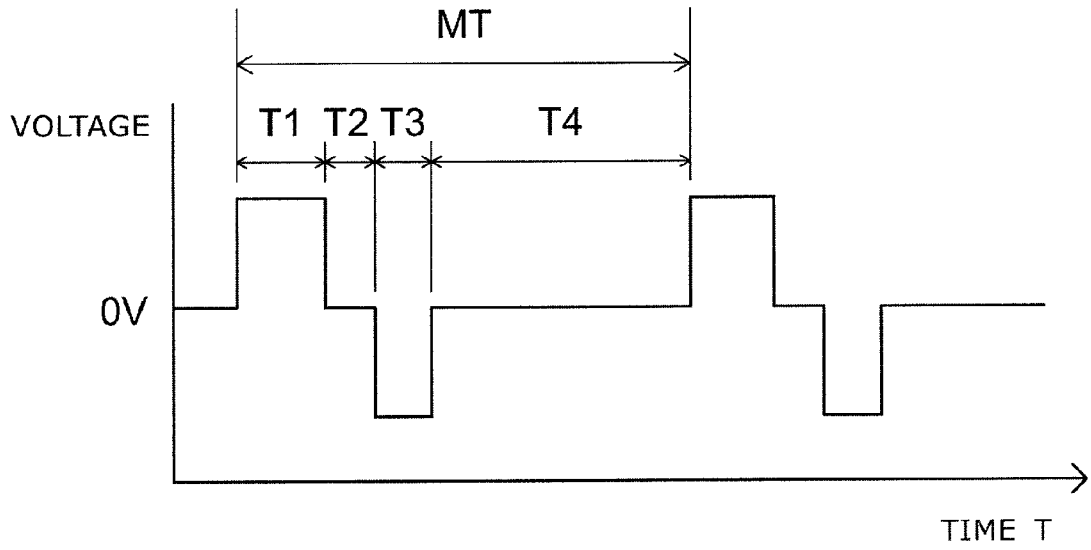
FIG. 14 is a schematic view for illustrating a voltage waveform applied to the pulsation generating device in a sanitary washing device according to a second embodiment.
Figure 15:
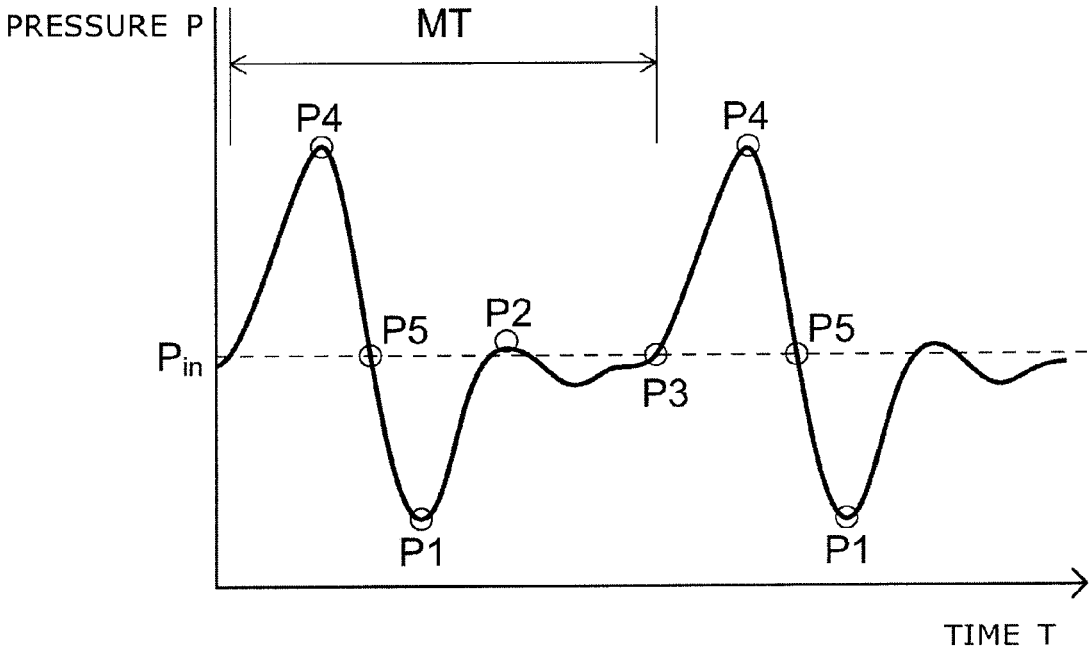
FIG. 15 is a timing chart for illustrating the pressure variation of wash water.
Figure 16:
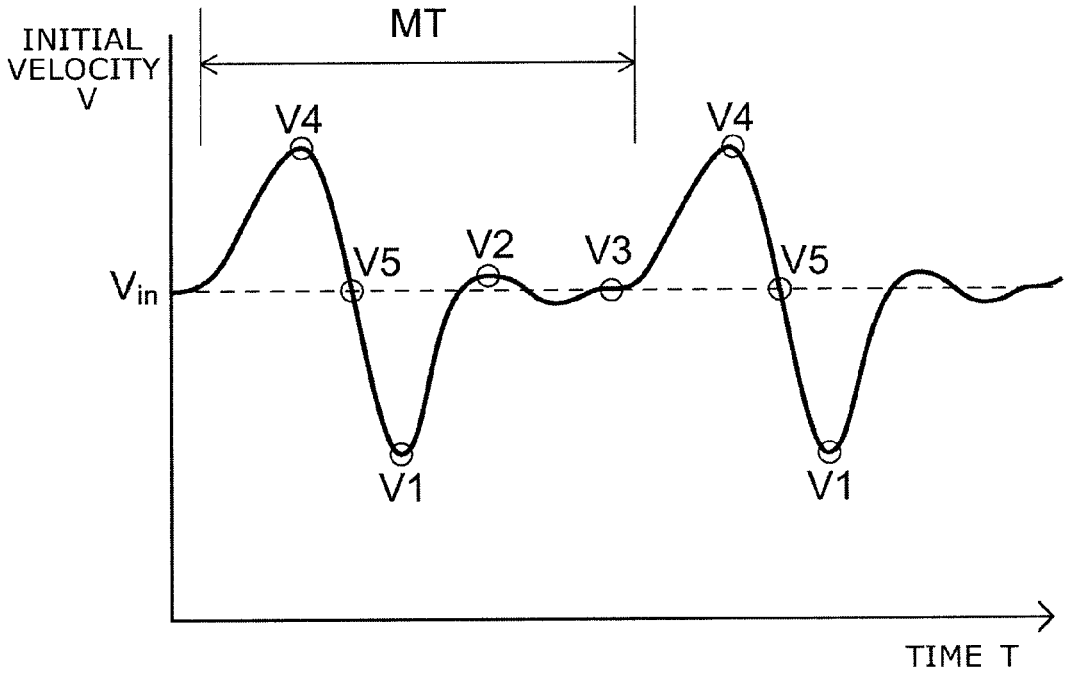
FIG. 16 is a timing chart for illustrating the velocity (initial velocity) change.

Next, a sanitary washing device according to a second embodiment of the invention is illustrated. FIG. 14 shows a voltage waveform applied to the pulsation generating device, FIG. 15 shows a timing chart of pressure variation of wash water at the nozzle tip caused by the pulsation generating device, and FIG. 16 shows a timing chart of velocity (initial velocity) change of discharged water caused by the pressure variation.

Figure 17:
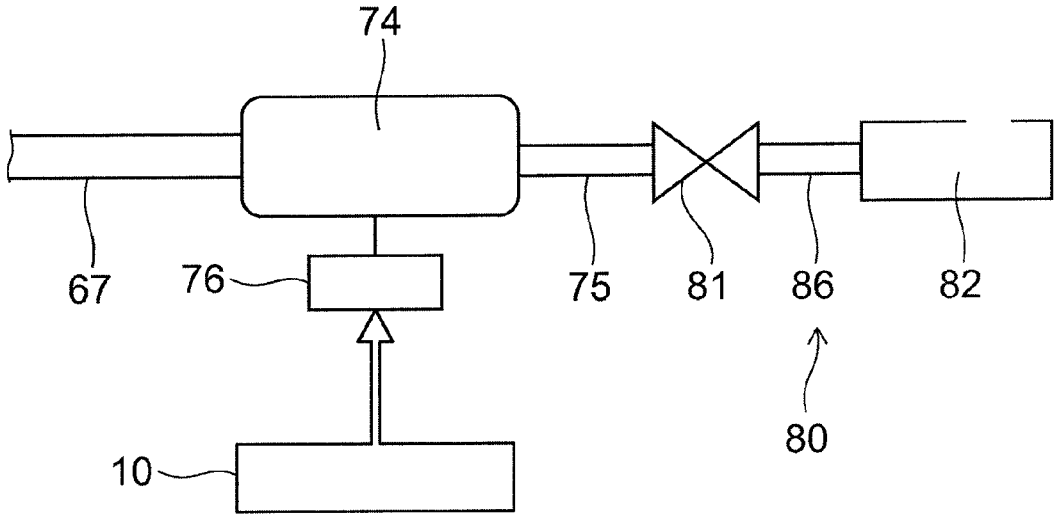
FIG. 17 is a schematic view for illustrating the pulsation generating device and the washing nozzle unit.

Furthermore, FIG. 17 is a schematic view for illustrating the pulsation generating device and the washing nozzle unit. In this case, the power supply 76 can apply a plus-side and minus-side voltage.

The configuration other than the foregoing is nearly the same as that according to the first embodiment. Hence, the detailed description of the same components of the second embodiment as those of the above first embodiment is omitted.

As shown in FIG. 14, a voltage waveform including a plus-side voltage and a subsequent minus-side voltage in one cycle is applied to the pulsation generating coil 74*d* of the pulsation generating device 74. Next, the state of water discharge caused by this voltage waveform is illustrated.

FIG. 16 shows a timing chart of the velocity (initial velocity) of wash water immediately after discharge from the water discharge port, calculated on the basis of the pressure value in FIG. 15. The state of change of the velocity (initial velocity) shown in FIG. 16 is illustrated with reference to the motion of the plunger 74*c* of the pulsation generating device 74.

In the on-time T1 of FIG. 14, a plus-side voltage is applied to the pulsation generating coil 74*d* of the pulsation generating device 74, and a current flows. Then, the pulsation generating coil 74*d* is excited, and the plunger 74*c* is magnetized and attracted to the downstream side. By this attraction to the downstream side, the return spring 74*f* is compressed to accumulate elastic energy. Simultaneously, wash water is pressurized, and the pressure of wash water reaches the highest pressure P4. At this time, the velocity of wash water discharged from the water discharge port 401 is maximized (V4).

Subsequently, when the application of voltage is stopped in the off-time T2, the excitation of the pulsation generating coil 74*d* is extinguished, and hence the plunger 74*c* returns toward the original position under the biasing force of the return spring 74*f*. Simultaneously, the pressure decreases. At this time, the velocity of wash water discharged from the water discharge port 401 slows down. Subsequently, in the on-time T3, by application of a minus-side voltage, the return velocity of the plunger 74*c* is accelerated. Consequently, the plunger 74*c* reaches the upstream side beyond the original position and compresses the buffer spring 74*e*.

Here, by the acceleration of the return velocity, the time to reach from the peak velocity V4 to the bottom velocity V1 can be reduced. In addition, because of reaching the upstream side beyond the original position, the bottom velocity V1 further decreases. The principle of the acceleration of the return velocity and its effect are described later. Subsequently, in the off-time T4, the plunger 74*c* returns again toward the original position under the biasing force of the buffer spring 74*e*.

Here, normally, the pressure only returns to the supply water pressure. However, by the biasing force of the buffer spring 74*e* and inflow of wash water, the pressure exceeds the supply water pressure and reaches a second peak pressure P2. Hence, the velocity also exhibits a second peak velocity V2 faster than that at the supply water pressure.

Furthermore, a certain period of time for water discharge near the velocity $V_{in}$ at the incoming water pressure occurs between the second peak velocity V2 and the timing when the plunger 74*c* is excited again (at the time when the velocity is V3).

Figure 18:
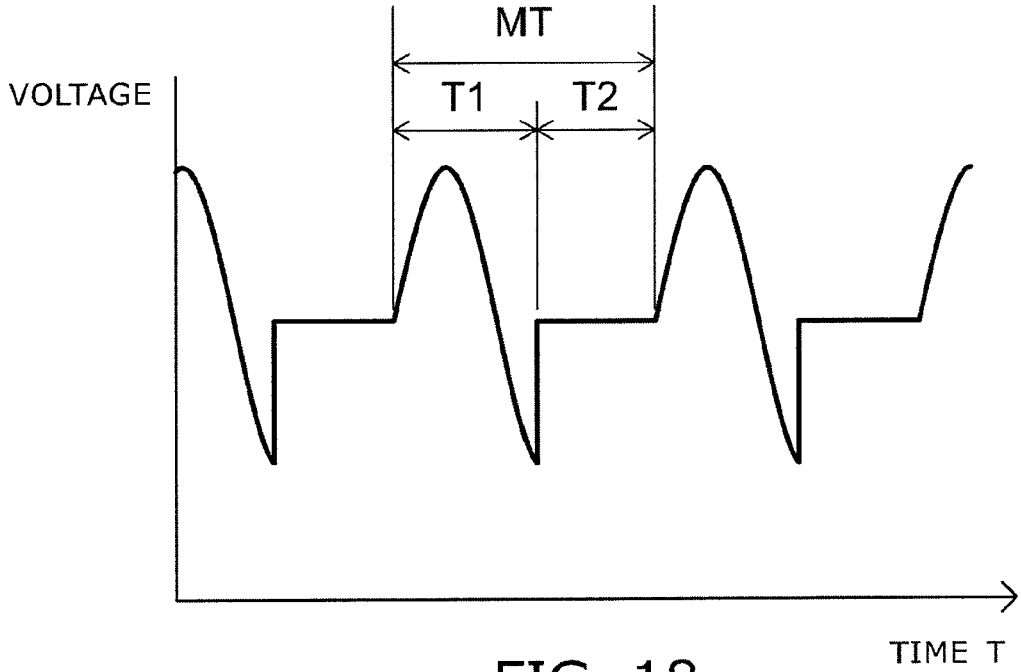
FIG. 18 is a schematic view for illustrating the voltage waveform of a sine waveform.

Here, with regard to the timing for the voltage waveform applied to the pulsation generating coil 74*d*, for instance, in the case where the frequency of pulsation is 50 Hz, the pulsation cycle MT is 20 msec. In this case, it is possible to set the on-time T1 to 4.8 msec, the off-time T2 to 1 msec, the on-time T3 to 1 msec, and the off-time T4 to 13.2 msec. However, the frequency and the time span of T1, T2, T3 are not limited to those illustrated, but can be suitably modified. Furthermore, the applied voltage waveform is not limited to the rectangular wave, but may be a sine waveform as shown in FIG. 18. In this case, the aforementioned effect can also be achieved by applying voltage halfway through the minus side by phase control.

Here, the effect achieved by applying the minus-side voltage is illustrated. The pulsation generating coil 74*d* is excited by a current flowing therein. Thus, the plunger 74*c* is magnetized, and the magnetized plunger 74*c* is attracted to the downstream side while compressing the return spring 74*f*. Subsequently, when the current is turned off, the excitation of the pulsation generating coil 74*d* is extinguished, and the magnetic force of the plunger 74*c* decreases. Hence, the plunger 74*c* returns to the original position by the biasing force of the return spring 74*f*.

At this time, even if the excitation of the pulsation generating coil 74*d* is extinguished, the magnetic force of the plunger 74*c* remains and produces a remanent magnetism. This remanent magnetism produces a force in the direction (downstream side) opposite to the biasing force of the return spring 74*f*. That is, by the effect of the remanent magnetism, a force is produced in the direction of preventing return to the original position.

Figure 19:
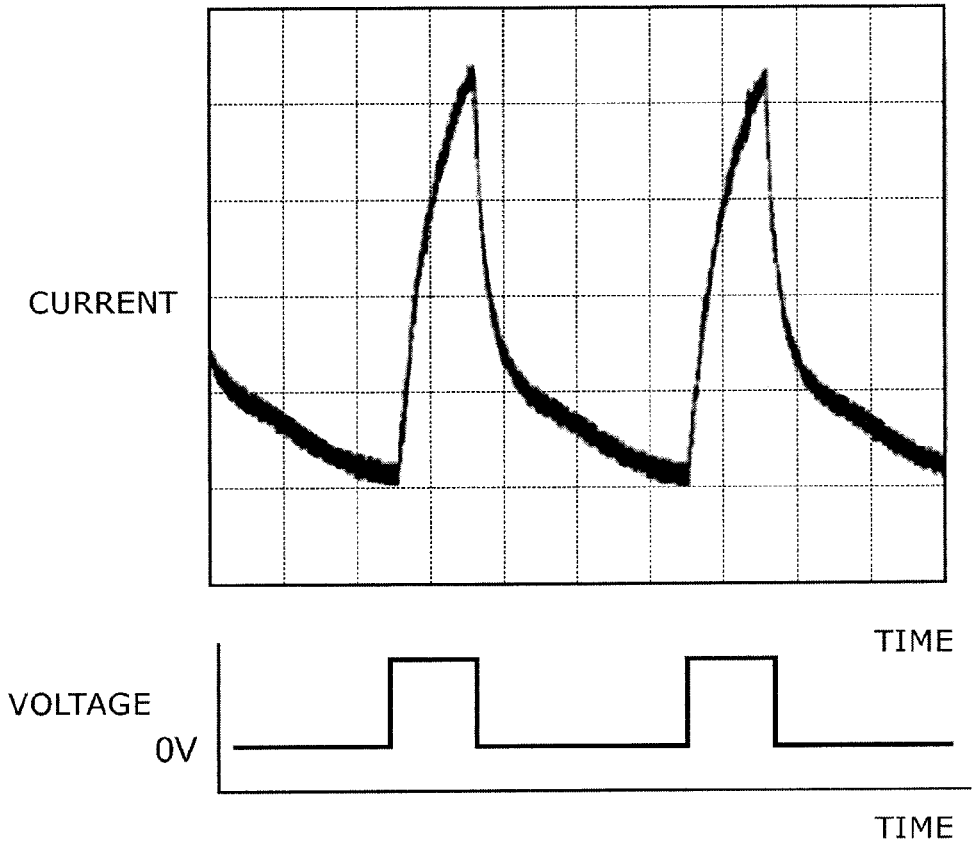
FIG. 19 is a schematic view for illustrating a temporal variation of the current flowing in the pulsation generating coil in the case where the remanent magnetism is produced.

FIG. 19 shows a temporal variation of the current flowing in the pulsation generating coil 74*d* in the case where the remanent magnetism is produced.

As shown in FIG. 19, it turns out that even if the voltage value becomes 0 V (zero volts), the current value does not immediately become 0 A (zero amperes), but the current flows in a lingering manner (the current value gradually decreases). This is caused by release of residual charge accumulated in the pulsation generating coil 74*d*. It turns out that this residual charge produces the remanent magnetism and results in producing a force in the opposite direction at the time of return of the plunger 74*c*.

In this state, by applying a minus-side voltage, a reverse current flows in the pulsation generating coil 74*d*. When the coil is excited, a reverse magnetic field occurs and can instantly decrease the remanent magnetism. That is, by applying a minus-side voltage as in the case of the on-time T3 in FIG. 14, a current in the opposite direction flows in the pulsation generating coil 74*d*, and hence a magnetic field in the opposite direction can be generated. Thus, by this magnetic field in the opposite direction, the remanent magnetism can be instantly decreased.

Figure 20:
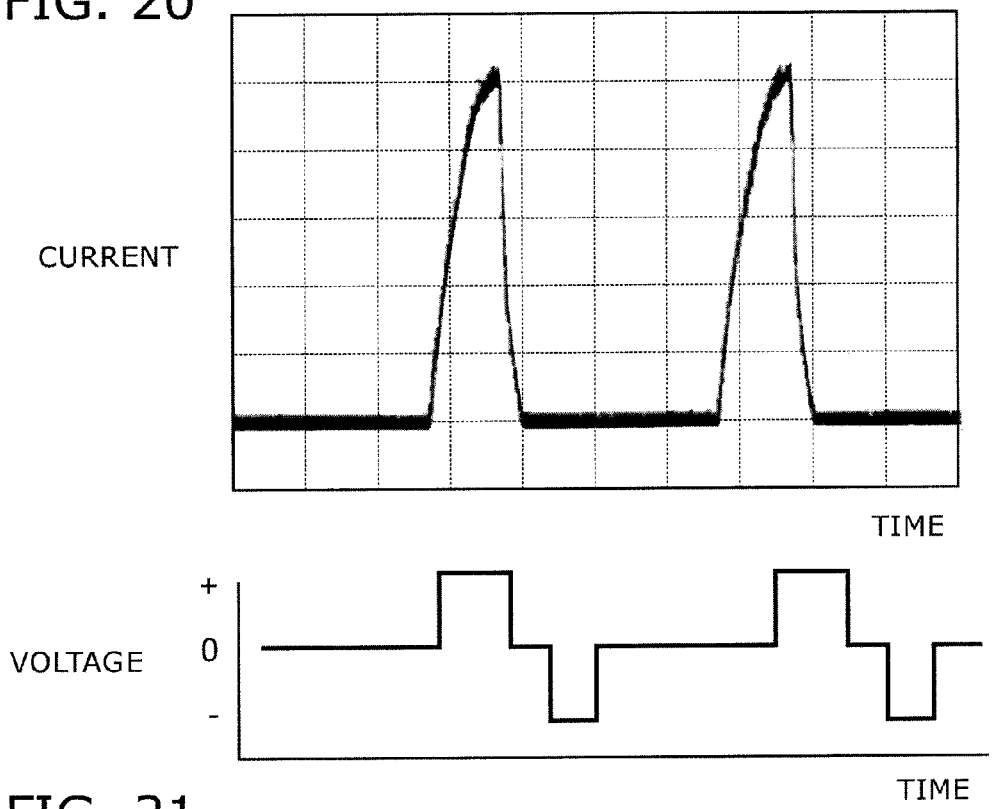
FIG. 20 is a schematic view for illustrating the state of the current flowing in the pulsation generating coil.

FIG. 20 shows the state of the current flowing in the pulsation generating coil 74*d* at this time. As seen in FIG. 20, nearly at the same time as the voltage applied to the pulsation generating coil 74*d* becomes 0 V, the current also becomes 0 A (zero amperes). Consequently, the effect of the remanent magnetism can be reduced, and the return velocity of the plunger 74*c* to the original position can be increased.

Thus, it is possible to reduce the time for transition from the peak velocity V4 to the bottom velocity V1, and to decrease the bottom velocity V1. Because the bottom velocity V1 can be decreased, when the velocity returns from the bottom velocity V1 to that at the supply water pressure, a second peak velocity V2 can be formed by rebound.

Furthermore, reduction of the time interval from the peak velocity V4 to the bottom velocity V1 serves to reduce the region of pressure decrease (velocity decrease), which makes little contribution to washing because no water discharge group is generated. That is, by reducing the time interval from the peak velocity V4 to the bottom velocity V1, it is possible to reduce the pressure-decreasing (velocity-decreasing) region which makes little contribution to washing because no water discharge group is generated.

Furthermore, the region for reaching from the bottom velocity V1 to the second peak velocity V2 can be formed earlier, and a sufficient free time can be formed between the second peak velocity V2 and the velocity V3 at the next timing for pressurization. This also leads to sufficiently expanding the interval available for water discharge groups with different sizes. That is, because the time for reaching from the bottom velocity V1 to the second peak velocity V2 can be reduced, it is possible to expand the interval between the time of the second peak velocity V2 and the time of the velocity V3, or the next timing for pressurization. Thus, it is possible to sufficiently expand the interval in which water discharge groups with different physical quantities are generated.

This leads to producing different water discharge groups at uniform time intervals in one cycle. Hence, it is possible to realize comfortable washing with little intermittent feeling even at a frequency lower than the dead band frequency region.

Figure 21:
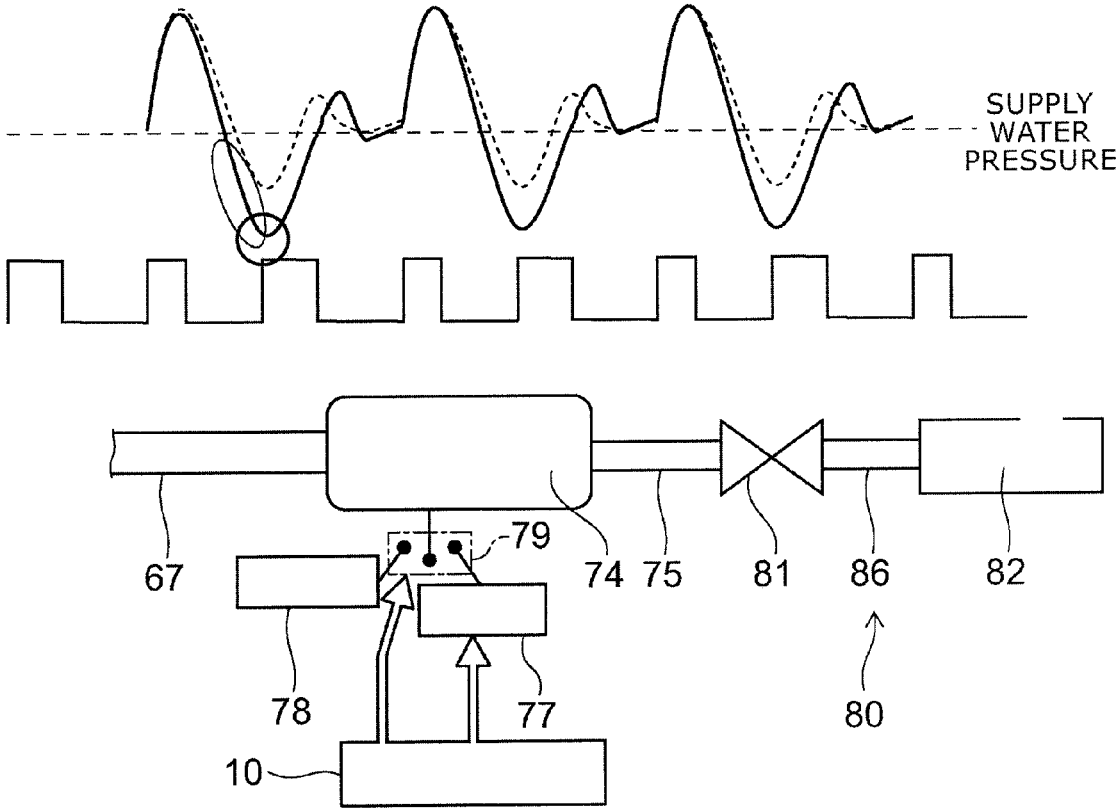
FIG. 21 is a schematic diagram for illustrating the case where a residual charge consuming circuit is provided.

The method for reducing the remanent magnetism is not limited to the method of applying a minus voltage. FIG. 21 is a schematic diagram for illustrating the case where a residual charge consuming circuit is provided.

Figure 22:
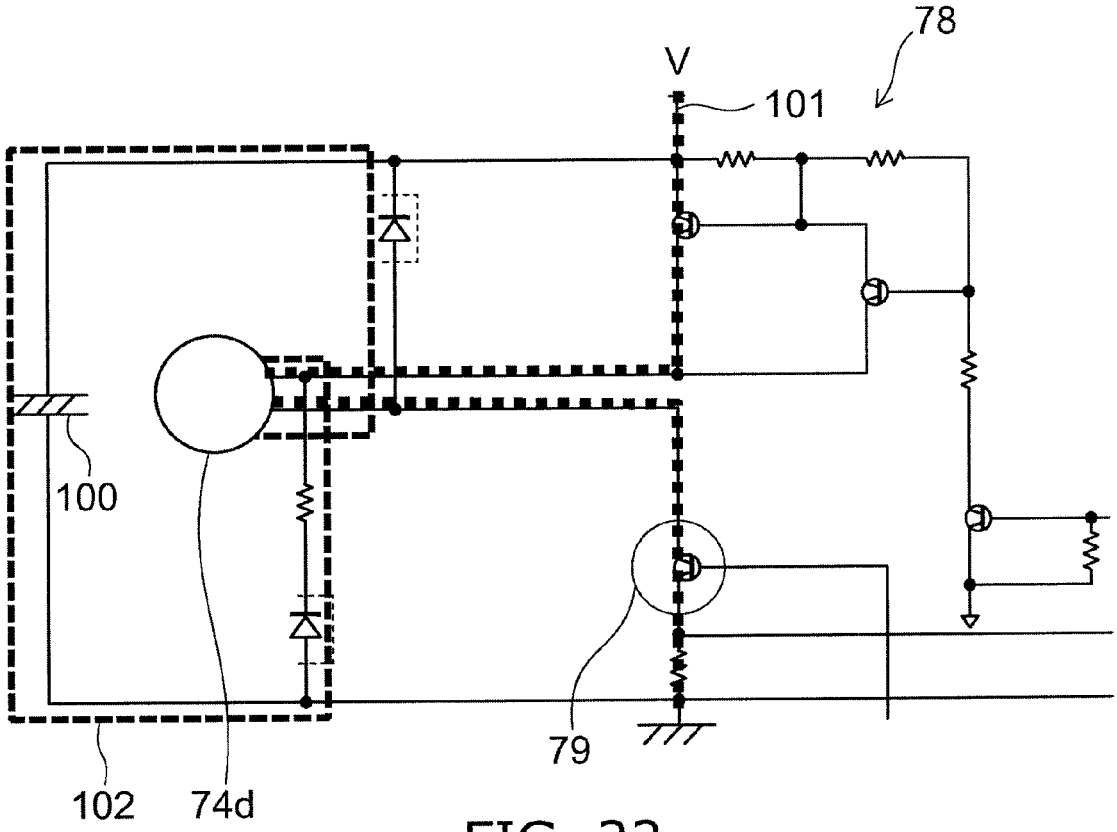
FIG. 22 is a schematic circuit diagram for illustrating the residual charge consuming circuit.

FIG. 22 is a schematic circuit diagram for illustrating the residual charge consuming circuit.

As shown in FIGS. 21 and 22, a similar effect can be achieved also by a power supply 77 for applying a voltage to the pulsation generating coil 74*d* and, additionally, a residual charge consuming circuit 78 which is switched by a switching transistor 79 at the timing of turn-off of the voltage of the pulsation generating coil 74*d* to consume the residual charge by a capacitor.

That is, it is also possible to provide the power supply 77 for applying a voltage to the pulsation generating coil 74*d*, the switching transistor 79 for performing switching at the timing when voltage application to the pulsation generating coil 74*d* is stopped, and the residual charge consuming circuit 78 including a capacitor 100 for consuming residual charge.

In this case, as shown in FIG. 22, in the state in which a voltage is applied to the pulsation generating coil 74*d* (on-state), a circuit current 101 in the figure flows. When the voltage application to the pulsation generating coil 74*d* is stopped (off-state), the switching transistor 79 is switched to pass a circuit current 102 so that the capacitor 100 consumes the residual charge.

Alternatively, a snubber circuit or a bridge circuit may be used to suppress the current value during the off-time of the voltage.

Figure 23:
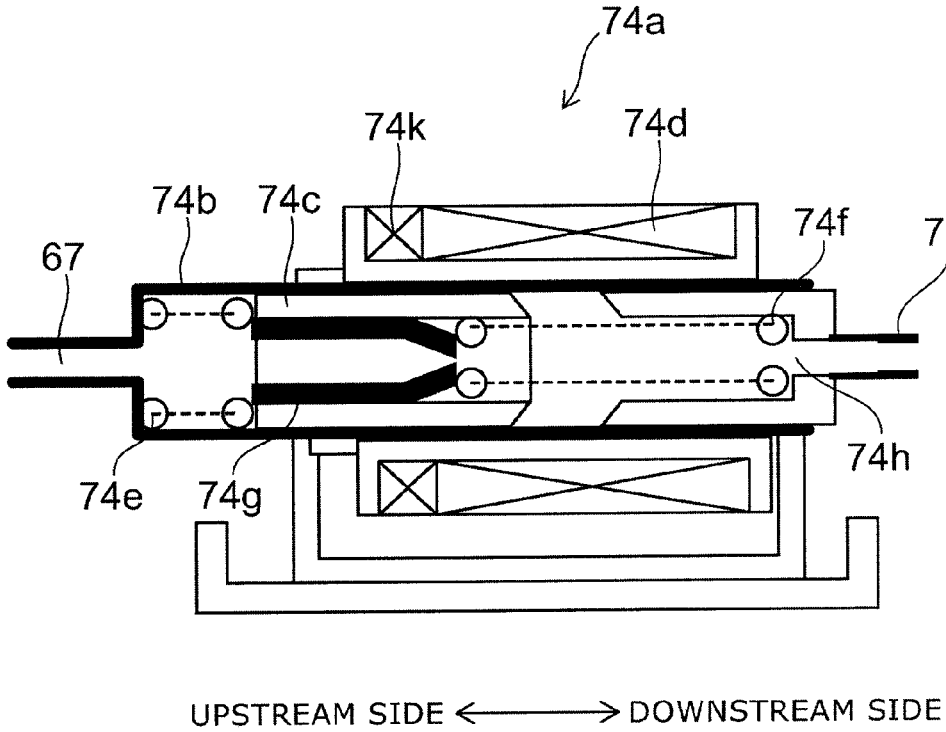
FIG. 23 is a schematic view for illustrating a variation of the pulsation generating device for accelerating the return velocity of the plunger.

The method for accelerating the return velocity of the plunger 74*c* is not limited to the method of reducing the remanent magnetism. FIG. 23 shows a variation of the pulsation generating device for accelerating the return velocity of the plunger 74*c*.

A pulsation generating device (pressurizer) 74*a* of this embodiment includes one pressurizing section. As shown in FIG. 23, a second coil 74*k* is provided on the upstream side of the pulsation generating coil 74*d* of the pulsation generating device 74*a*. That is, the pulsation generating device 74*a* includes a pulsation generating coil 74*d* and a second coil 74*k* provided on the upstream side of the pulsation generating coil 74*d*. Simple rectangular waves different in phase are applied to the pulsation generating coil 74*d* and the second coil 74*k*. Thus, because a voltage is applied to the second coil 74*k* at the timing when the plunger 74*c* returns, the plunger 74*c* is sucked into the second coil 74*k*. Hence, because the return velocity of the plunger 74*c* can be accelerated, an effect similar to that in the aforementioned case can be achieved.

The method for accelerating the return velocity of the plunger by providing the second coil 74*k* may be used in combination with the generation of two pulses illustrated in the second embodiment. That is, the method for accelerating the return velocity of the plunger by providing the second coil 74*k* may be used in combination with the method for accelerating the return velocity of the plunger by using a voltage waveform including a plus-side voltage and a minus-side voltage. This leads to making the large water discharge group even larger and making the fast water discharge group even faster, and it is possible to further increase the feeling of stimulation and the feeling of volume.

As illustrated above, various means can be used for the time reducing section (time reducer) for reducing time in which the inner pressure of the washing nozzle drops after the second water discharge process for generating a "water discharge group having a small water discharge cross-sectional area and a fast velocity". For instance, the time reducing section can be the aforementioned one capable of reducing the remanent magnetism, or the aforementioned second coil 74*k*.

Here, the time reducing section can be one for reducing time in which the pressure drops after a second pressurization is performed to discharge wash water in a region of pressure at least higher than the supply water pressure for generating a "water discharge group having a large water discharge cross-sectional area and a slow velocity" in the second water discharge process.

Next, a sanitary washing device according to a third embodiment is illustrated.

Figure 24:
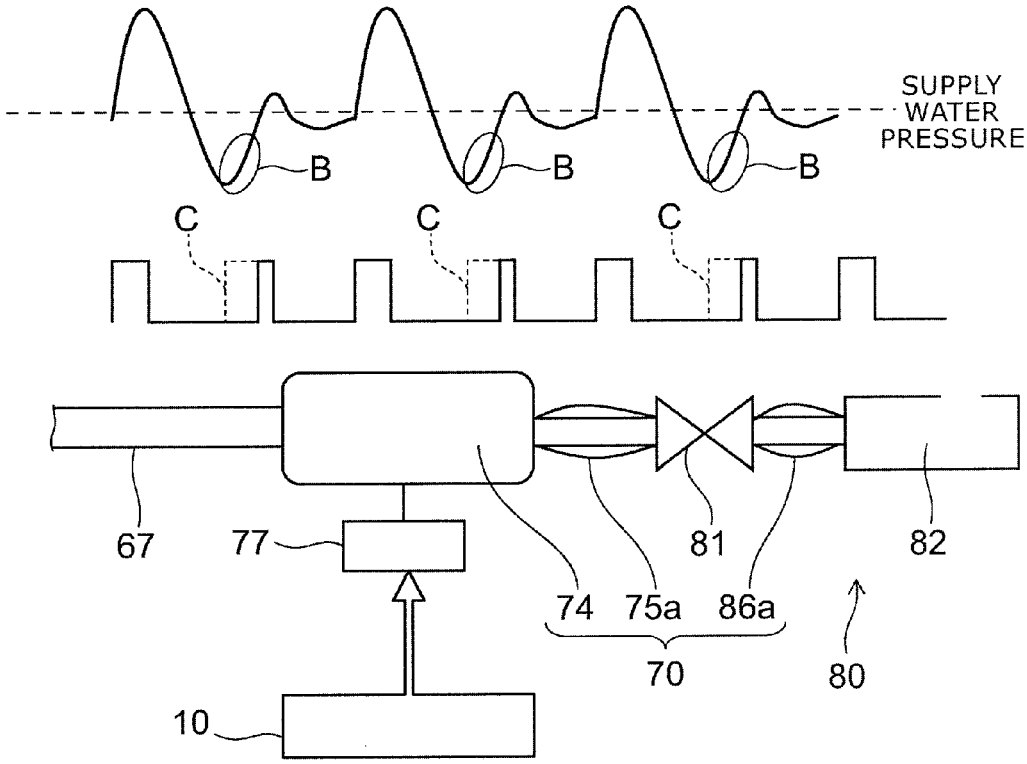
FIG. 24 is a schematic diagram for illustrating the case where a pressure accumulating section is provided in a sanitary washing device according to a third embodiment.

FIG. 24 is a schematic diagram for illustrating the case where a pressure accumulating section is provided. The components similar to those described above are labeled with like reference numerals, and the description thereof is omitted.

The pulsation generating unit 70 of this embodiment includes the pulsation generating device 74 and pressure accumulating sections (pressure accumulators) 75*a*, 86*a*. As shown in FIG. 24, the pulsation generating device 74 and the flow rate regulating/flow channel switching valve 81 are connected by the pressure accumulating section 75*a*. The flow rate regulating/flow channel switching valve 81 and the washing nozzle 82 are connected by the pressure accumulating section 86*a*.

The pressure accumulating sections 75*a*, 86*a* can be ones elastically deformed in response to water pressure. For instance, they can be tubes or the like formed from resin, rubber or the like.

The elastic energy accumulated in the pressure accumulating sections 75*a*, 86*a* in response to water pressure can be used to help pressurize wash water. In particular, in the low pressure region, pressurization of wash water can be effectively performed. For instance, in the region indicated by "B" in FIG. 24, pressurization of wash water can be effectively performed.

In this case, by using the pressurizing action of the pressure accumulating sections 75*a*, 86*a*, the time of voltage application in the region indicated by "B" can be reduced as indicated by "C". Thus, it is possible to reduce power consumption, and to reduce the amount of heat generation of the pulsation generating device 74.

Although FIG. 24 illustrates the case where the pressure accumulating section 75*a* and the pressure accumulating section 86*a* are provided, it is possible to provide at least one of them.

Furthermore, the elastic energy accumulated in the pressure accumulating sections 75*a*, 86*a* can be varied by suitably selecting the spring constant and the like of the material.

Next, a sanitary washing device according to a fourth embodiment is illustrated.

Figure 25:
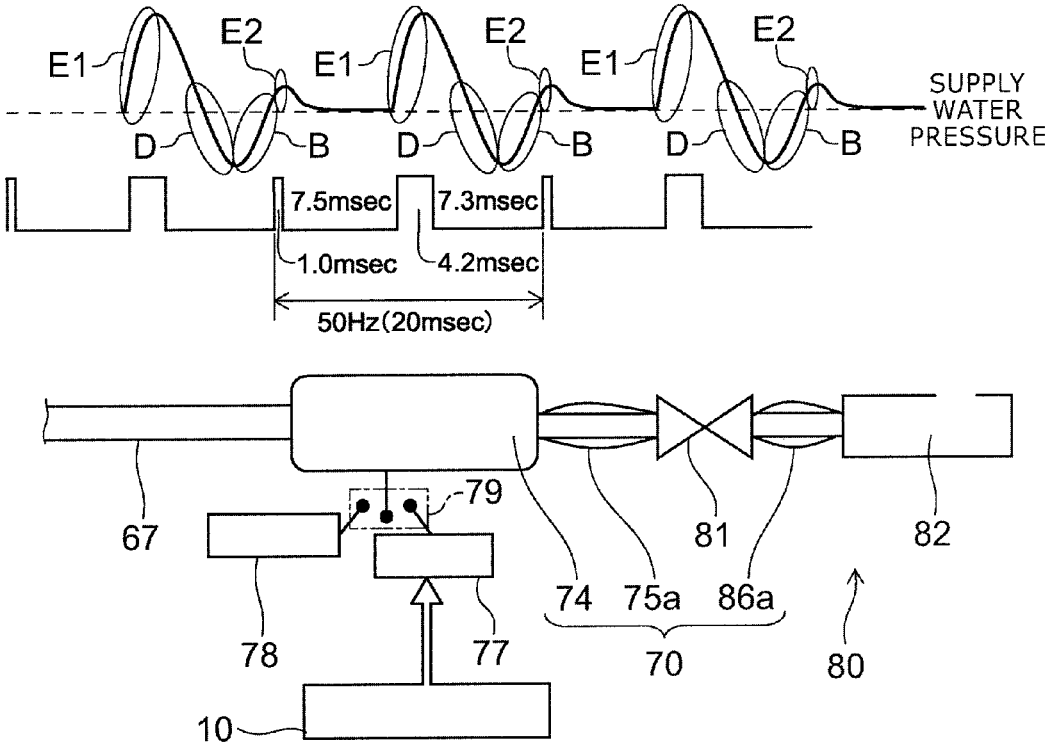
FIG. 25 is a schematic diagram for illustrating the case where a residual charge consuming circuit and a pressure accumulating section are provided in a sanitary washing device according to a fourth embodiment.

FIG. 25 is a schematic diagram for illustrating the case where a residual charge consuming circuit and a pressure accumulating section are provided. The components similar to those described above are labeled with like reference numerals, and the description thereof is omitted.

The pulsation generating unit 70 of this embodiment includes the pulsation generating device 74 and the pressure accumulating sections 75*a*, 86*a*. In this embodiment, at the timing corresponding to the region indicated by "D" in FIG. 25, the remanent magnetism can be reduced by the action of the residual charge consuming circuit 78. Furthermore, in the region indicated by "B", pressurization of wash water can be effectively performed by the action of the pressure accumulating sections 75*a*, 86*a*. Furthermore, in the regions indicated by "E1", "E2", pressurization of wash water can be actively performed by the action of the pulsation generating device 74.

The details of the action and effect related to the residual charge consuming circuit 78, the pressure accumulating sections 75*a*, 86*a*, and the pulsation generating device 74 are similar to those described above, and hence are omitted.

As a variation, an air mixing section, not shown, may be provided so that air can be mixed from the tip portion (the wash water vortex chambers 301, 302 in FIG. 4) of the washing nozzle 82. The air mixing section can be such that air pressurized by an air pump for forcibly introducing air is mixed from a tube connected to the tip of the washing nozzle 82. In this case, by controlling the air pump in synchronization with the pressure variation (see FIG. 6) caused by the pulsation generating device, the timing when the pressurized air is mixed can be adjusted.

For instance, the air pump can be controlled in synchronization with the voltage waveform applied to the pulsation generating device so that air is mixed in the up-gradient range of the slow velocity region. Thus, when air is mixed at the timing when a large water discharge group is generated, the water discharge group is scattered into a wide range. That is, the apparent water discharge cross-sectional area is increased by air and results in a higher feeling of volume.

On the other hand, in the fast velocity region, by preventing air from mixing, the wash water with a fast velocity is discharged without scattering, and impinges on the human body private parts while maintaining the velocity. Thus, it is possible to establish compatibility between the feeling of stimulation and the feeling of volume in the state of higher feeling of volume. Here, because the air mixing section is provided at the tip of the washing nozzle 82, air can be efficiently mixed. Furthermore, because air is not mixed more than necessity in the fast velocity region, it is also possible to prevent the feeling of stimulation from attenuating due to the damper effect of air.

The disposing position of the air mixing section is not limited to the tip of the washing nozzle 82, but it may be provided so that air can be mixed into the piping on the upstream side of the washing nozzle 82. Furthermore, the air mixing section is not necessarily one capable of forcible mixing, but may be based on natural aspiration. In the case of using natural aspiration, air is mixed into wash water as bubbles. If air is mixed into wash water as bubbles, the volume of the water discharge group can be increased. Consequently, it is possible to establish compatibility between the feeling of stimulation and the feeling of volume in the state of higher feeling of volume.

As illustrated above, a "water discharge group having a large water discharge cross-sectional area and a slow velocity" and a "water discharge group having a small water discharge cross-sectional area and a fast velocity" are generated by varying the amount of overtaking by which the wash water discharged later overtakes the wash water discharged earlier.

That is, the controller 10 is configured to perform a first control in a first water discharge process (the process for generating a "water discharge group having a large water discharge cross-sectional area and a slow velocity") and a second control in a second water discharge process (the process for generating a "water discharge group having a small water discharge cross-sectional area and a fast velocity"). The water discharge of wash water by the first water discharge process and the water discharge of wash water by the second water discharge process are performed from the same water discharge port. In the first water discharge process, the initial velocity at the time of water discharge is made lower than in the second water discharge process so that at a predetermined position from the water discharge port, the amount of overtaking by which the wash water discharged earlier is overtaken by the wash water discharged later is larger than in the second water discharge process. In the second water discharge process, the initial velocity at the time of water discharge is made higher than in the first water discharge process so that at the predetermined position from the water discharge port, the amount of overtaking by which the wash water discharged earlier is overtaken by the wash water discharged later is smaller than in the first water discharge process. The first water discharge process and the second water discharge process are alternately performed so that the water discharge of wash water by the first water discharge process and the water discharge of wash water by the second water discharge process are alternately discharged from the same water discharge port.

Thus, the feeling of volume can be produced by the "water discharge group having a large water discharge cross-sectional area and a slow velocity". Furthermore, the feeling of stimulation can be produced by the "water discharge group having a small water discharge cross-sectional area and a fast velocity".

Consequently, even with a limited amount of water, it is possible to realize a highly comfortable sanitary washing device which can produce the feeling of volume and the feeling of stimulation just like being washed with a large amount of water.

Here, the feeling of discharged water with the feeling of stimulation and the feeling of volume can be produced by causing each of the aforementioned "different water discharge groups" to impinge on the human body private parts at least once in the dead band frequency region of approximately 5 Hz or more which a human being cannot perceive as intentional repetition of water discharge.

Furthermore, in the first water discharge process, a region of pressure lower than the supply water pressure is formed so that wash water is discharged in the region of pressure lower than the supply water pressure to decrease the initial velocity at the time of water discharge, thereby increasing the amount of overtaking. In the second water discharge process, wash water is discharged in the region of pressure higher than the supply water pressure so that the initial velocity at the time of water discharge is higher than in the first water discharge process.

Furthermore, the pressurizer includes a single pressurizing section, and the controller 10 is configured to perform a first pressurization by the pressurizer in the first water discharge process, and a second pressurization by the pressurizer in the second water discharge process. Then, a "water discharge group having a large water discharge cross-sectional area and a slow velocity" and a "water discharge group having a small water discharge cross-sectional area and a fast velocity" can be generated by the pulsation generating device 74 including one pressurizing section. Thus, the structure of the pulsation generating device 74 can be further simplified. Furthermore, the initial velocity at the time of water discharge can be set to an appropriate value by a simple control configuration of using the pulsation generating device 74 including one pressurizing section to perform the first pressurization in a region of pressure at least lower than the supply water pressure and perform the second pressurization in a region of pressure at least higher than the supply water pressure in the first water discharge process. That is, a sharp velocity difference can be provided to the initial velocity at the time of water discharge between in the water discharge by the first pressurization and in the water discharge by the second pressurization.

Furthermore, a "predetermined waiting time" is provided between the control for generating a "water discharge group having a large water discharge cross-sectional area and a slow velocity" and the control for generating a "water discharge group having a small water discharge cross-sectional area and a fast velocity". That is, the off-time T4 is provided. Hence, a sufficient time interval can be provided between the wash water discharged with the velocity V2 and the wash water discharged with the velocity V4. Consequently, the "different water discharge groups" can be caused to independently impinge on the human body private parts with different velocities without mutual interference. This leads to producing different water discharge groups at uniform time intervals in one cycle. Hence, it is possible to realize comfortable washing with little intermittent feeling even at a frequency lower than the dead band frequency region. Furthermore, by causing each impingement of water in the dead band frequency region, it is also possible to produce the feeling of discharged water with the feeling of stimulation and the feeling of volume.

Furthermore, when in the region of pressure lower than the supply water pressure, generation of a "water discharge group having a large water discharge cross-sectional area and a slow velocity" is started. Hence, because the velocity can be slowed down, it is possible to increase the amount of wash water discharged later overtaking the wash water discharged earlier. This consequently facilitates generating a "water discharge group having a large water discharge cross-sectional area and a slow velocity".

Furthermore, by further using the region higher than the supply water pressure formed by rebound at the time of return from the bottom velocity V1 (at the time when the pressure returns to the supply water pressure), the time of water discharge for generating the "water discharge group having a large water discharge cross-sectional area and a slow velocity" can be prolonged. Hence, the size of the "water discharge group having a large water discharge cross-sectional area and a slow velocity" can be further increased.

On the other hand, a high pressure region is formed by active pressurization from the neighborhood of the supply water pressure so that a "water discharge group having a small water discharge cross-sectional area and a fast velocity" is generated in the high pressure region. Hence, because the velocity can be accelerated, it is possible to suppress the situation in which the wash water discharged later overtakes the wash water discharged earlier. This consequently facilitates generating a "water discharge group having a small water discharge cross-sectional area and a fast velocity".

Furthermore, by further increasing the pressure P4 by active pressurization from the neighborhood of the supply water pressure, the pressure P1 formed subsequently is further decreased. This can facilitate forming the aforementioned "region of pressure lower than the supply water pressure".

Furthermore, active pressurization is performed at the time of return of pressure to the supply water pressure. This makes it possible to rapidly and stably obtain the pressure around the supply water pressure.

A pressure accumulating section is further provided between the pulsation generating device 74 and the washing nozzle 82 to accumulate the pressure from wash water. The pressure accumulating section accumulates the pressure from wash water in the second water discharge process and applies the accumulated pressure to wash water in the first water discharge process. In this case, in the second water discharge process, a second pressurization is performed to discharge wash water in a region of pressure at least higher than the supply water pressure, and the pressure from wash water is accumulated in the pressure accumulating section by this second pressurization so that the pressure accumulated in the pressure accumulating section can be applied to wash water in the state in which the pressure of wash water is lower than the supply water pressure.

Then, part of the high pressure at the time of generating a "water discharge group having a small water discharge cross-sectional area and a fast velocity" is accumulated in the second water discharge process so that the accumulated pressure can be used in generating a "water discharge group having a large water discharge cross-sectional area and a slow velocity". Consequently, the "water discharge group having a large water discharge cross-sectional area and a slow velocity" can be generated reliably and efficiently.

The pressure accumulating section can provide wash water with the pressure accumulated when the wash water pressure is lower than the supply water pressure. Such a pressure accumulating section can be formed by suitably selecting the spring constant and the like of the material. By providing such a pressure accumulating section, the pressure accumulated at a lower wash water pressure can be applied to wash water. Hence, water discharge can be started at a lower pressure, that is, at a slower velocity. Thus, because the amount of overtaking can be increased, a larger "water discharge group having a large water discharge cross-sectional area and a slow velocity" can be generated.

Furthermore, the pressure accumulating section can be formed as an elastically deformable hose used for a supply water conduit connecting between the pulsation generating device 74 and the washing nozzle 82. Then, the pressure accumulating section can be formed from a simple configuration of an elastically deformable hose.

Furthermore, in the first water discharge process, in combination with application of pressure by the pressure accumulating section, the first pressurization by the pressurizer can be performed. Then, the "water discharge group having a large water discharge cross-sectional area and a slow velocity" can be generated by both the pressurization by the pressure accumulating section and the first pressurization by the pressurizer. Hence, a "water discharge group having a large water discharge cross-sectional area and a slow velocity" with a predetermined size can be generated more reliably.

Furthermore, the first pressurization can be performed in the second half of the process for performing water discharge in the first water discharge process. By performing the first pressurization in the second half of the process, its timing can be shifted from the pressurization by the pressure accumulating section. That is, the pressurization by the pressure accumulating section and the first pressurization can be performed not in parallel but in series. Thus, it is possible to suppress the increase of the velocity of wash water, and to perform water discharge with a slow velocity for a long period of time. Consequently, a "water discharge group having a large water discharge cross-sectional area and a slow velocity" with a predetermined size can be generated more reliably.

Furthermore, the time for which the first pressurization is performed by the pressurizer can be controlled to be shorter than the time for which the second pressurization is performed by the pressurizer. Then, the time of pressurization by the pressurizer in the first water discharge process can be reduced, and hence the device lifetime can be extended by the reduction of control time.

Furthermore, the waiting time can be terminated when the inner pressure of the washing nozzle 82 becomes the supply water pressure.

Then, the second water discharge process performed after the waiting time can be started in the state with the pressure stabilized. Thus, the pressurization energy in the second water discharge process can be efficiently used to accelerate wash water, and hence the velocity of the "water discharge group having a small water discharge cross-sectional area and a fast velocity" can be reliably increased.

Furthermore, the waiting time can be established so as to equalize the interval between the impingement of the first water drop formed by the first water discharge process and the impingement of the second water drop formed by the second water discharge process.

This can equalize the time interval between when the "water discharge group having a large water discharge cross-sectional area and a slow velocity" and the "water discharge group having a small water discharge cross-sectional area and a fast velocity" impinge on the human body private parts, and hence can produce more continuous feeling.

Furthermore, "different water discharge groups" are generated by using the pulsation generating device 74 including one pressurizing section and controlling the timing of operation thereof. Furthermore, the condition for generating the "different water discharge groups" is controlled so as to be appropriate. This can lead to downsizing, simplification, cost reduction and the like of the sanitary washing device 1.

Next, another variation of the pulsation generating device (pressurizer) is illustrated.

Figure 26:
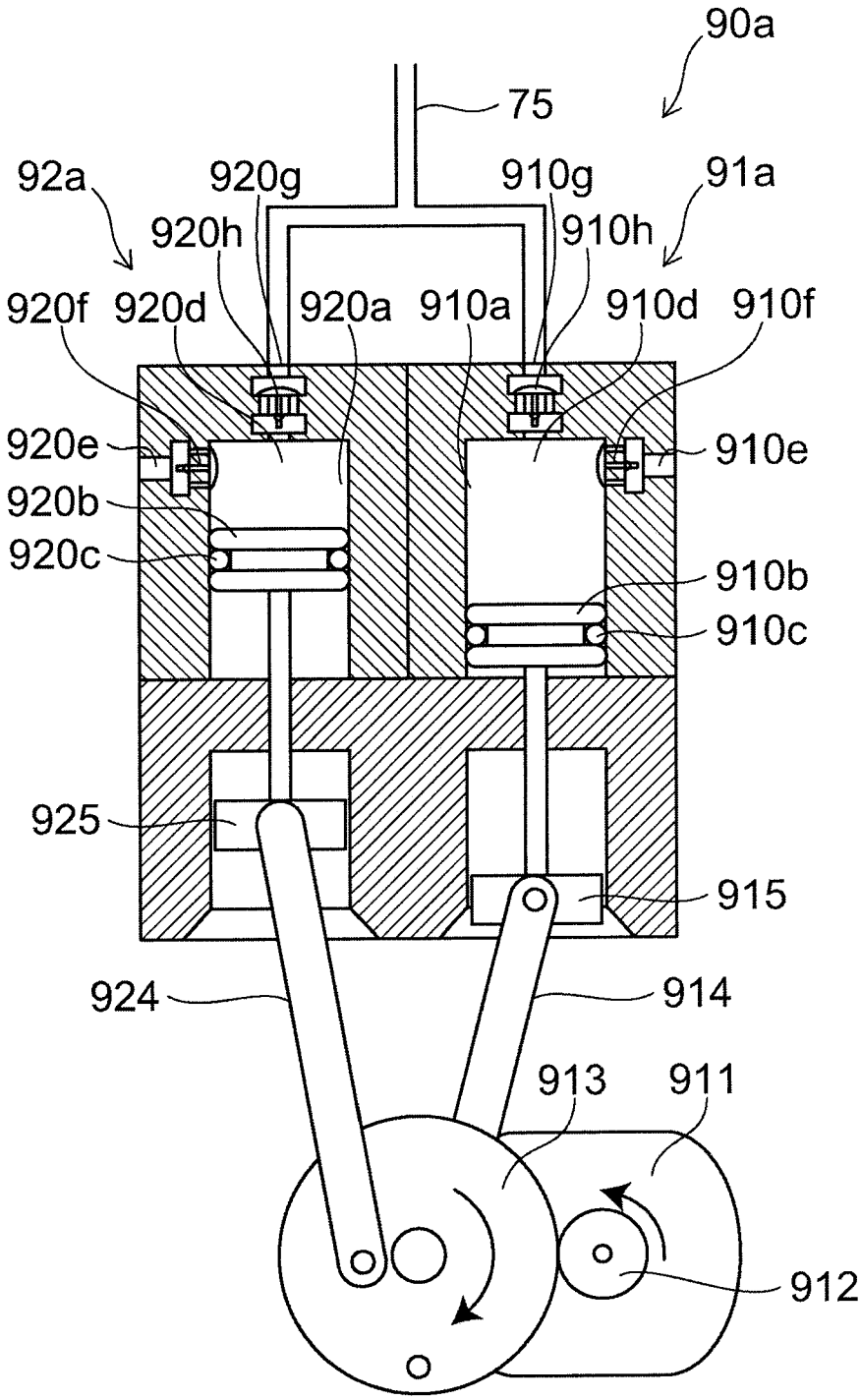
FIG. 26 is a schematic configuration sectional view for illustrating a pulsation generating section of the motor-driven reciprocating type.

FIG. 26 is a schematic configuration sectional view for illustrating a pulsation generating section 90*a* of the motor-driven reciprocating type.

The pulsation generating section (pressurizer) 90*a* has a dual configuration composed of a first pulsation generating section (first pressurizing section) 91*a* and a second pulsation generating section (second pressurizing section) 92*a*. The first pulsation generating section 91*a* and the second pulsation generating section 92*a* include cylinders 910*a*, 920*a*, respectively, each including a cylindrical space. A piston 910*b*, 920*b* is provided in the cylinder 910*a*, 920*a*. The piston 910*b*, 920*b* is equipped with an O-ring 910*c*, 920*c*. Each space defined by the piston 910*b*, 920*b* and the cylinder 910*a*, 920*a* constitutes a pressurizing chamber 910*d*, 920*d*.

The pressurizing chamber 910*d*, 920*d* is provided with a wash water inlet 910*e*, 920*e* so that wash water branched from the supply water conduit 67 flows thereto. That is, the pressurizing chambers 910*d*, 920*d* are provided with the wash water inlets 910*e*, 920*e*, respectively. A conduit, not shown, branched from the supply water conduit 67 is connected to the wash water inlet 910*e*, 920*e* so that wash water can be caused to flow from the supply water conduit 67 into the pressurizing chamber 910*d*, 920*d*.

Here, umbrella packings 910*f*, 920*f* are provided so as to prevent backflow. That is, the umbrella packing 910*f*, 920*f* is provided in the portion where the wash water inlet 910*e*, 920*e* opens to the pressurizing chamber 910*d*, 920*d* so that the wash water poured into the pressurizing chamber 910*d*, 920*d* does not flow back to the supply water conduit 67 side.

Furthermore, wash water outlets 910*g*, 920*g* are provided and merged on the way to eject the pressurized wash water. That is, the wash water outlets 910*g*, 920*g* are provided in the ceiling portion of the pressurizing chambers 910*d*, 920*d*, respectively. A piping is connected to each of the wash water outlets 910*g*, 920*g*, and each connected piping is connected to the supply water conduit 75 through a bifurcation. Thus, flows of wash water flowing out of the pressurizing chambers 910*d*, 920*d* are merged on the way and ejected to the supply water conduit 75 as pressurized wash water.

Here, again, umbrella packings 910*h*, 920*h* are used to prevent backflow. That is, the wash water outlet 910*g*, 920*g* is provided with the umbrella packing 910*h*, 920*h* so that the wash water flowing out to the supply water conduit 75 side does not flow back into the pressurizing chamber 910*d*, 920*d*.

A gear 912 is attached to the rotary shaft of a motor 911 and meshed with a gear 913. A crankshaft 914 for driving the piston 910*b* of the first pulsation generating section 91*a* and a crankshaft 924 for driving the piston 920*b* of the second pulsation generating section 92*a* are attached to different positions of the gear 913. The crankshaft 914, 924 is attached to the piston 910*b*, 920*b* through a piston holder 915, 925. Here, the positions of the crankshafts attached to the gear 913 are different in attachment radius so that the amount of stroke of the piston 910*b* is different from that of the piston 920*b*, and they are attached to positions 90° out of phase. Furthermore, the stroke of the piston 920*b* of the second pulsation generating section 92*a* is adjusted so as to be shorter than the stroke of the piston 910*b* of the first pulsation generating section 91*a* and driven 90° out of phase. Thus, because the operation of the pistons 910*b*, 920*b* is adjusted in advance by the attachment positions of the crankshafts 914, 914 on the gear 913, it is possible to cause the pulsation generating section 90*a* to perform a predetermined operation by a simple control of only turning on/off the energization switch of the motor.

When a user selects and pushes the washing button, the motor 911 is energized to rotate the rotary shaft. Thus, the pistons 910*b*, 920*b* are vertically reciprocated through the gears 912, 913, the crankshaft 914, and the piston holders 915, 925.

When the pressurizing chamber is filled with wash water, if the piston 910*b* (920*b*) moves from the lower dead center (original position) to the upper dead center, the volume of the pressurizing chamber decreases. Hence, the wash water is pressurized and driven toward the supply water conduit 75.

Subsequently, in return from the upper dead center to the lower dead center (original position), the pressure in the pressurizing chamber decreases, and the umbrella packing 910*f*, 920*f* opens to allow wash water to flow into the pressurizing chamber. Subsequently, at the next time of piston movement, the wash water is pressurized again. This process is successively performed to generate pressure variation, or pulsation. Here, the stroke of the piston 920*b* is adjusted to be approximately half the stroke of the piston 910*b* and 90° out of phase. However, the cycle is the same. Although the pressurizing time is equal, the piston 920*b* has a short stroke, and hence can form a large first water drop by gradual pressurization. On the other hand, the piston 910*b* has a long stroke, and hence can form a region of high pressure by rapidly increasing the pressure. Thus, it can form a second water drop having a fast velocity.

Next, a sanitary washing device according to a fifth embodiment is illustrated.

Figure 27:
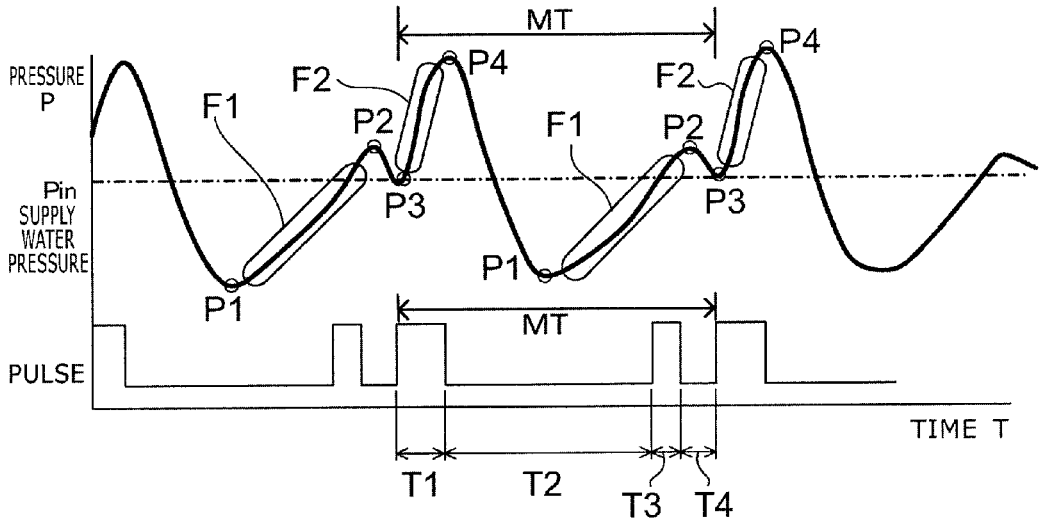
FIG. 27 is a timing chart showing the pressure variation of wash water and the voltage waveform applied to the pulsation generating device in a sanitary washing device according to a fifth embodiment.

FIG. 27 is a timing chart showing the pressure variation of wash water and the voltage waveform applied to the pulsation generating device.

Figure 28:
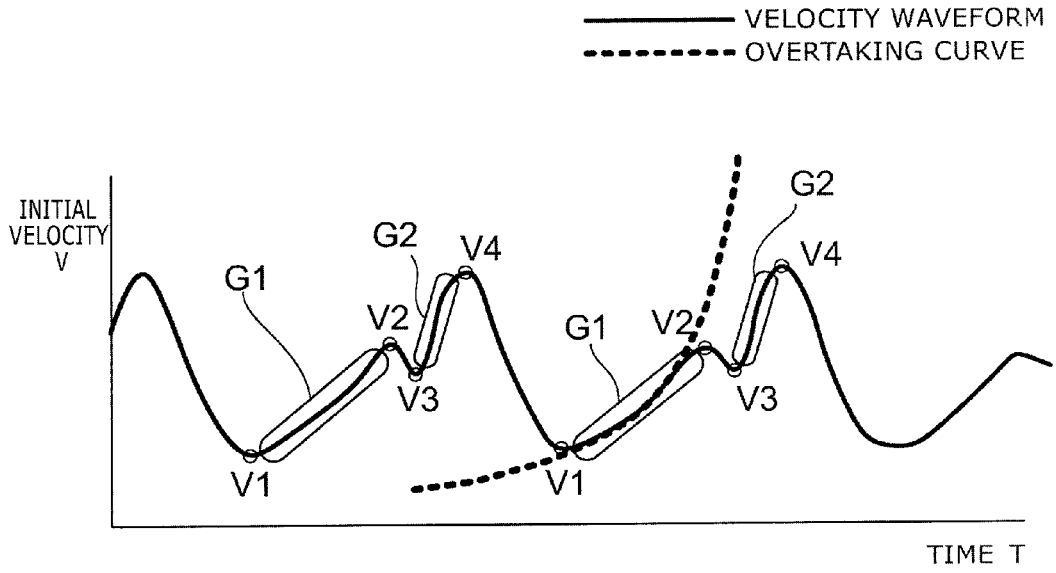
FIG. 28 is a timing chart showing the velocity (initial velocity) of wash water immediately after discharge from the water discharge port in the sanitary washing device according to the fifth embodiment.

FIG. 28 is a timing chart showing the velocity (initial velocity) of wash water immediately after discharge from the water discharge port.

Here, the upper row of FIG. 27 is a timing chart illustrating the pressure variation of wash water. The lower row of FIG. 27 is a timing chart illustrating the voltage waveform applied to the pulsation generating device.

The components similar to those described above are labeled with like reference numerals, and the description thereof is omitted.

In this embodiment, as shown in FIG. 27, the pulse-like voltage applied to the pulsation generating coil 74*d* of the pulsation generating device 74 has a voltage waveform in which two rectangular waves with different on-times are combined during one cycle. The pressure change and velocity change of wash water immediately after discharge from the water discharge port caused by this control are illustrated with reference to the motion of the plunger 74*c* of the pulsation generating device 74. The voltage of the voltage waveform shown in FIG. 27 is applied to the pulsation generating coil 74*d* of the pulsation generating device 74.

When the voltage is applied to the pulsation generating coil 74*d* of the pulsation generating device 74 with on-time T1, a current flows. Hence, the pulsation generating coil 74*d* is excited, and the plunger 74*c* is magnetized. Then, if the plunger 74*c* is magnetized, the plunger 74*c* is attracted to the side of the pulsation generating coil 74*d*, that is, to the downstream side.

By this attraction to the downstream side, the return spring 74*f* is compressed to accumulate elastic energy, and simultaneously pressurizes wash water to the highest pressure P4. At this time, the velocity of wash water discharged from the water discharge port 401 is maximized (V4). That is, when the plunger 74*c* is attracted to the downstream side, the return spring 74*f* is compressed, and elastic energy is accumulated therein. Simultaneously, wash water is pressurized by the plunger 74*c*. Here, when the pressure of wash water reaches the highest pressure P4, the velocity of wash water discharged from the water discharge port 401 is maximized (V4).

Subsequently, when the voltage is turned off in T2, the excitation of the pulsation generating coil 74*d* is extinguished, and the original position is recovered under the biasing force of the return spring 74*f*. That is, when the application of voltage is stopped with off-time T2, the excitation of the pulsation generating coil 74*d* is canceled. Hence, the plunger 74*c* is returned to the original position by the biasing force of the return spring 74*f*. Simultaneously, the pressure decreases to the lowest pressure P1. At this time, the velocity of wash water discharged from the water discharge port 401 also decreases to the lowest velocity region V1.

Subsequently, the pressure begins to return to the supply water pressure Pin, and the velocity also begins to return to the velocity Vin at the supply water pressure. At this timing of return, a rectangular wave with on-time T3 shorter than T1 is applied to excite the pulsation generating coil 74*d* and attract the plunger 74*c* to the downstream side, thereby pressurizing the wash water again. That is, at this timing of return, a rectangular-wave voltage with on-time T3 shorter than T1 is applied to the pulsation generating coil 74*d*. Thus, the wash water is pressurized again by exciting the pulsation generating coil 74*d* and attracting the plunger 74*c* to the downstream side.

Here, because the pressure is on the way of return and T3 is shorter in time than T1, the wash water does not rise to the highest pressure P4, but reaches a second peak pressure P2 higher than the supply water pressure. Hence, the velocity also exhibits a second peak velocity V2 faster than the velocity at the supply water pressure. Furthermore, a certain period of time for water discharge near the velocity Vin at the incoming water pressure occurs between the second peak velocity V2 and a velocity V3 at the timing when the plunger is excited again.

Here, in the sanitary washing device according to this embodiment, the up-gradient of pressure, or the pressure increment of wash water per unit time, in the region indicated by "F1" (between the pressure P1 and the pressure P2) in FIG. 27 is smaller than the up-gradient of pressure, or the pressure increment of wash water per unit time, in the region indicated by "F2" (between the pressure P3 and the pressure P4) in FIG. 27. In other words, the pressure increment of wash water per unit time in the region indicated by "F2" in FIG. 27 is larger than the pressure increment of wash water per unit time in the region indicated by "F1" in FIG. 27.

Put differently, the up-gradient of velocity (initial velocity), or the velocity (initial velocity) increment of wash water per unit time, in the region indicated by "G1" (between the velocity V1 and the velocity V2) in FIG. 28 is smaller than the up-gradient of velocity (initial velocity), or the velocity (initial velocity) increment of wash water per unit time, in the region indicated by "G2" (between the velocity V3 and the velocity V4) in FIG. 28. In other words, the velocity (initial velocity) increment of wash water per unit time in the region indicated by "G2" in FIG. 28 is larger than the velocity (initial velocity) increment of wash water per unit time in the region indicated by "G1" in FIG. 28.

Accordingly, in the region indicated by "F1" in FIG. 27, by increasing the pressure of wash water relatively slowly from the pressure P1 to the pressure P2, the velocity (initial velocity) of wash water discharged from the water discharge port increases relatively slowly from the velocity V1 to the velocity V2. Thus, at a predetermined position, it is possible to further increase the amount of overtaking by which the wash water discharged later (e.g., the wash water discharged with the velocity V2) overtakes the wash water discharged earlier (e.g., the wash water discharged with the velocity V1). Hence, the large water discharge group for producing the feeling of volume can be generated with a larger size.

On the other hand, in the region indicated by "F2" in FIG. 27, by increasing the pressure of wash water relatively rapidly from the pressure P3 to the pressure P4, the velocity (initial velocity) of wash water discharged from the water discharge port increases relatively rapidly from the velocity V3 to the velocity V4. Thus, although the amount of water is small, it is possible to generate a water discharge group with a relatively fast velocity.

That is, in this embodiment, in the process for generating a "water discharge group having a large water discharge cross-sectional area and a slow velocity" for producing the feeling of volume, the water discharge cross-sectional area can be further increased by ensuring a sufficient amount of overtaking. Furthermore, in the process for generating a "water discharge group having a small water discharge cross-sectional area and a fast velocity" for producing the feeling of stimulation, although the amount of water is small, it is possible to generate a water discharge group with a relatively fast velocity. Hence, it is possible to realize highly comfortable washing which reliably establishes compatibility between the feeling of volume and the feeling of stimulation while reducing the total amount of water used.

The waveform of the velocity (initial velocity) of wash water in the region indicated by "G2" in FIG. 28 runs generally along the overtaking curve superimposed with the reference point set to the velocity V2 (i.e., the overtaking curve determined with reference to the velocity V2). Hence, in the process for generating a "water discharge group having a large water discharge cross-sectional area and a slow velocity" for producing the feeling of volume, wash waters different in the timing of water discharge and the velocity of water discharge can be caused to simultaneously impinge on the impinging position at a predetermined distance. Thus, although the amount of water is small, it is possible to provide the same feeling as in the case of washing with a large amount of water. That is, while reducing the amount of water used, it is possible to reliably provide the feeling of volume.

Also in this embodiment, the pulsation generating device 74 can be combined with the pressure accumulating sections 75*a*, 86*a* described above with reference to FIGS. 24 and 25. Then, the elastic energy accumulated in the pressure accumulating sections 75*a*, 86*a* in response to water pressure can be used to help pressurize wash water. In particular, in the low pressure region, pressurization of wash water can be effectively performed. For instance, in the first half of the region indicated by "F1" in FIG. 27, pressurization of wash water can be effectively performed.

In this case, by using the pressurizing action of the pressure accumulating sections 75*a*, 86*a*, the time T3 of voltage application in the region indicated by "F1" in FIG. 27 can be reduced. Thus, it is possible to reduce power consumption, and to reduce the amount of heat generation of the pulsation generating device 74. Furthermore, the other effects of the pressure accumulating sections 75*a*, 86*a* are also achieved similarly to the effects of the pressure accumulating sections 75*a*, 86*a* described above with reference to FIGS. 24 and 25.

Next, a sanitary washing device according to a sixth embodiment is illustrated.

Figure 29:
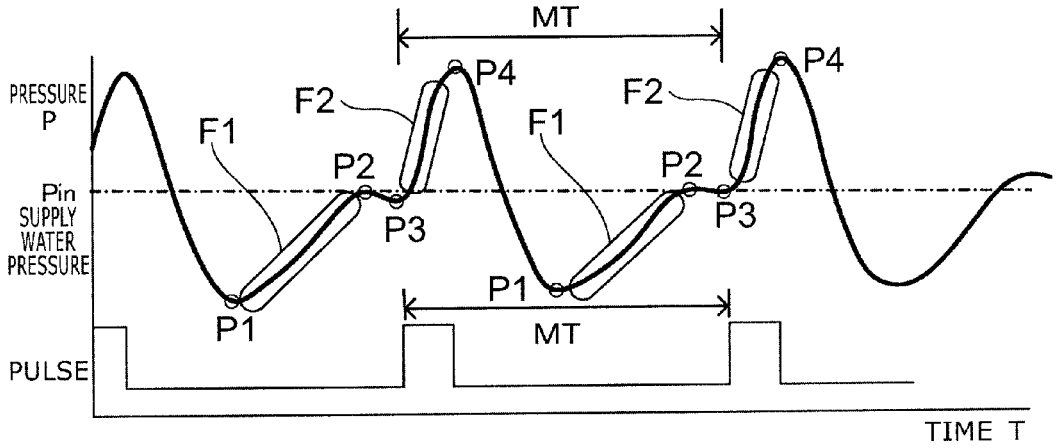
FIG. 29 is a timing chart showing the pressure variation of wash water and the voltage waveform applied to the pulsation generating device in a sanitary washing device according to a sixth embodiment.

FIG. 29 is a timing chart showing the pressure variation of wash water and the voltage waveform applied to the pulsation generating device.

Figure 30:
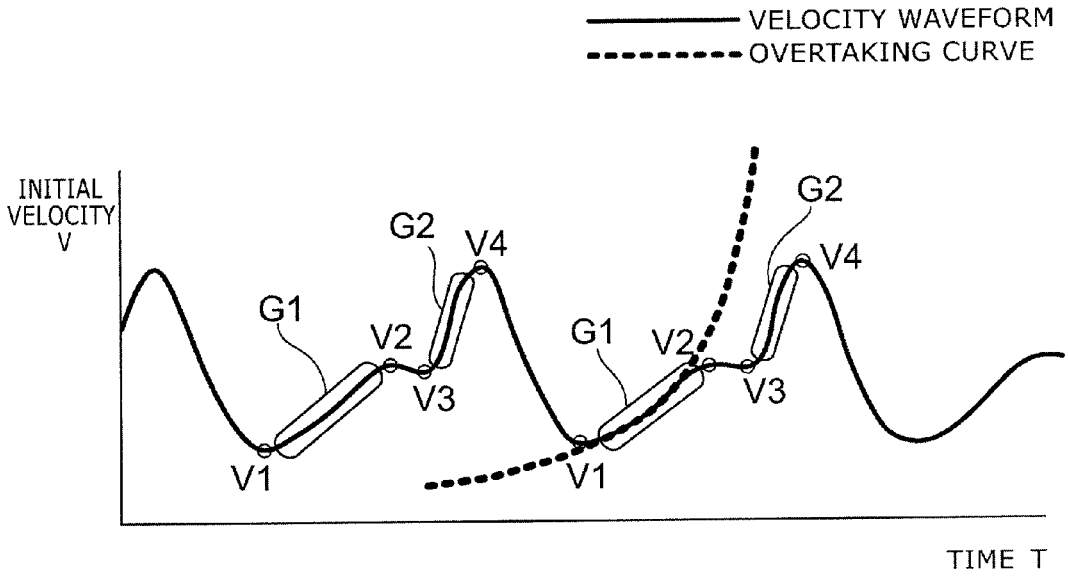
FIG. 30 is a timing chart showing the velocity (initial velocity) of wash water immediately after discharge from the water discharge port in the sanitary washing device according to the sixth embodiment.

FIG. 30 is a timing chart showing the velocity (initial velocity) of wash water immediately after discharge from the water discharge port.

Here, the upper row of FIG. 29 is a timing chart illustrating the pressure variation of wash water. The lower row of FIG. 29 is a timing chart illustrating the voltage waveform applied to the pulsation generating device.

The components similar to those described above are labeled with like reference numerals, and the description thereof is omitted.

In this embodiment, the rectangular-wave voltage is not applied to the pulsation generating coil 74*d* when the pressure of wash water is about to return from the lowest pressure P1 to the supply water pressure Pin and the velocity is about to return to the velocity Vin at the supply water pressure. That is, the voltage corresponding to the rectangular-wave voltage in the time T3 shown in FIG. 27 is not applied. The rest of the operation of the pulsation generating device 74 and the pulse-like voltage applied to the pulsation generating coil 74*d* of the pulsation generating device 74 are similar to those in the sanitary washing device according to the embodiment described above with reference to FIGS. 27 and 28.

In this embodiment, no voltage is applied at the timing when the pressure of wash water is about to return from the lowest pressure P1 to the supply water pressure Pin. However, the pressure of wash water becomes comparable to the supply water pressure or reaches a second peak pressure P2 beyond the supply water pressure by the biasing force of the buffer spring 74*e* and the inflow of wash water. Hence, the velocity also becomes comparable to that at the supply water pressure or a second peak velocity V2 faster than that at the supply water pressure. Furthermore, a certain period of time for water discharge near the velocity $V_{in}$ at the incoming water pressure occurs between the second peak velocity V2 and the timing when the plunger 74*c* is excited again (at the time when the velocity is V3).

Here, in the sanitary washing device according to this embodiment, the up-gradient of pressure, or the pressure increment of wash water per unit time, in the region indicated by "F1" (between the pressure P1 and the pressure P2) in FIG.

29 is smaller than the up-gradient of pressure, or the pressure increment of wash water per unit time, in the region indicated by "F2" (between the pressure P3 and the pressure P4) in FIG. 29. In other words, the pressure increment of wash water per unit time in the region indicated by "F2" in FIG. 29 is larger than the pressure increment of wash water per unit time in the region indicated by "F1" in FIG. 29.

Put differently, the up-gradient of velocity (initial velocity), or the velocity (initial velocity) increment of wash water per unit time, in the region indicated by "G1" (between the velocity V1 and the velocity V2) in FIG. 30 is smaller than the up-gradient of velocity (initial velocity), or the velocity (initial velocity) increment of wash water per unit time, in the region indicated by "G2" (between the velocity V3 and the velocity V4) in FIG. 30. In other words, the velocity (initial velocity) increment of wash water per unit time in the region indicated by "G2" in FIG. 30 is larger than the velocity (initial velocity) increment of wash water per unit time in the region indicated by "G1" in FIG. 30.

Accordingly, as described above with reference to FIGS. 27 and 28, in the process for generating a "water discharge group having a large water discharge cross-sectional area and a slow velocity" for producing the feeling of volume, the water discharge cross-sectional area can be further increased by ensuring a sufficient amount of overtaking. Furthermore, in the process for generating a "water discharge group having a small water discharge cross-sectional area and a fast velocity" for producing the feeling of stimulation, although the amount of water is small, it is possible to generate a water discharge group with a relatively fast velocity. Hence, it is possible to realize highly comfortable washing which reliably establishes compatibility between the feeling of volume and the feeling of stimulation while reducing the total amount of water used.

The waveform of the velocity (initial velocity) of wash water in the region indicated by "G2" in FIG. 30 runs generally along the overtaking curve superimposed with the reference point set to the velocity V2 (i.e., the overtaking curve determined with reference to the velocity V2). Hence, in the process for generating a "water discharge group having a large water discharge cross-sectional area and a slow velocity" for producing the feeling of volume, wash waters different in the timing of water discharge and the velocity of water discharge can be caused to simultaneously impinge on the impinging position at a predetermined distance. Thus, although the amount of water is small, it is possible to provide the same feeling as in the case of washing with a large amount of water. That is, while reducing the amount of water used, it is possible to reliably provide the feeling of volume.

Also in this embodiment, the pulsation generating device 74 can be combined with the pressure accumulating sections 75*a*, 86*a* described above with reference to FIGS. 24 and 25. Then, the elastic energy accumulated in the pressure accumulating sections 75*a*, 86*a* in response to water pressure can be used to help pressurize wash water. In particular, in the low pressure region, pressurization of wash water can be effectively performed. For instance, in the first half of the region indicated by "F1" in FIG. 29, pressurization of wash water can be effectively performed. Furthermore, the other effects of the pressure accumulating sections 75*a*, 86*a* are also achieved similarly to the effects of the pressure accumulating sections 75*a*, 86*a* described above with reference to FIGS. 24 and 25.

INDUSTRIAL APPLICABILITY

This invention can provide a sanitary washing device discharging supplied wash water toward a human body, comprising:

a washing nozzle including a water discharge port configured to discharge the wash water toward the human body; and a pressurizing device configured to pressurize the wash water and discharge it from the water discharge port, the sanitary washing device being configured to perform a first water discharge process having a first time span and a second water discharge process having a second time span, in the first water discharge process, the pressurizing device making pressure of wash water discharged later in the first time span higher than pressure of wash water discharged at beginning of the first water discharge process so that the wash water discharged later in the first time span overtakes and unites with the wash water discharged at beginning of the first water discharge process to form a first water drop at a predetermined position from the water discharge port, and in the second water discharge process, the pressurizing device making pressure of wash water discharged later in the second time span higher than pressure of wash water discharged at beginning of the second water discharge process so that the wash water discharged later in the second time span overtakes and unites with the wash water discharged at beginning of the second water discharge process to form a second water drop at a predetermined position from the water discharge port, and the pressurizing device changing the pressure of wash water so that the first water drop is larger than the second water drop, and the pressurizing device making maximum pressure of wash water in the second water discharge process higher than maximum pressure of wash water in the first water discharge process so that the second water drop is faster than the first water drop, and a water discharged by the first water discharge process and a water discharged by the second water discharge process being alternately discharged from the water discharge port.

EXPLANATION OF REFERENCE

1 sanitary washing device
10 controller
40 water discharge port
50 water inlet side valve unit
51 strainer
52 check valve
53 solenoid valve
54 pressure regulator valve
55 supply water conduit
60 heat exchange unit
61 heater
62 heat exchanger
**62*a*** incoming water temperature sensor
**62*b*** outgoing water temperature sensor
63 float switch
64 vacuum breaker
65 safety valve
66 waste water piping
67 supply water conduit
70 pulsation generating unit
73 water hammer reduction accumulator
**73*a*** housing
**73*b*** damper chamber
**73*c*** damper
74 pulsation generating device
**74*a*** pulsation generating device
**74*b*** cylinder
**74*c*** plunger
**74*d*** pulsation generating coil

74*e* buffer spring
74*f* return spring
74*g* check valve
74*h* downstream side
74*k* second coil
75 supply water conduit
75*a* pressure accumulating section
76 power supply
77 power supply
78 residual charge consuming circuit
79 switching transistor
81 flow rate regulating/flow channel switching valve
82 washing nozzle
83 washing flow channel
84 washing flow channel
85 washing flow channel
86 supply water conduit
86*a* pressure accumulating section
90*a* pulsation generating section
91*a* pulsation generating section
92*a* pulsation generating section
100 capacitor
101 circuit current
102 circuit current
301 wash water vortex chamber
302 wash water vortex chamber
401 water discharge port
402 water discharge port
910*a* cylinder
910*b* piston
910*c* ring
910*d* pressurizing chamber
910*e* wash water inlet
910*f* umbrella packing
910*g* wash water outlet
910*h* umbrella packing
911 motor
912 gear
913 gear
914 crankshaft
915 piston holder
920*b* piston
924 crankshaft

What is claimed is:

1. A sanitary washing device discharging supplied wash water toward a human body, comprising:

a washing nozzle including a water discharge port configured to discharge the wash water toward the human body; and a pressurizing device configured to pressurize the wash water and discharge the wash water from the water discharge port, the sanitary washing device being configured to perform a first water discharge process having a first time span and a second water discharge process having a second time span, in the first water discharge process, the pressurizing device making pressure of wash water discharged later in the first time span higher than pressure of wash water discharged at beginning of the first water discharge process so that the wash water discharged later in the first time span overtakes and unites with the wash water discharged at beginning of the first water discharge process to form a first water drop at a predetermined position from the water discharge port, in the second water discharge process, the pressurizing device making pressure of wash water discharged later in the second time span higher than pressure of wash water discharged at beginning of the second water discharge process so that the wash water discharged later in the second time span overtakes and unites with the wash water discharged at beginning of the second water discharge process to form a second water drop at a predetermined position from the water discharge port, the pressurizing device making difference between pressure changes of wash water in the first water discharge process and pressure changes of wash water in the second water discharge process so that the first water drop is larger than the second water drop, the pressurizing device making maximum pressure of the wash water in the second water discharge process higher than maximum pressure of the wash water in the first water discharge process so that the second water drop is faster than the first water drop, and a water discharged by the first water discharge process and a water discharged by the second water discharge process being alternately discharged from the water discharge port.

2. The sanitary washing device according to claim 1, wherein a predetermined waiting time is provided at the time after completion of the first water discharge process and before beginning of the second water discharge process so that the second water drop formed in the second water discharge process does not overtake first water drop formed in the first water discharge process at the predetermined position.

3. The sanitary washing device according to claim 2, wherein the waiting time is provided so that a first time interval from when water discharged by the first water discharge process is discharged from the water discharge port until water discharged by the second water discharge process is discharged from the water discharge port is longer than a second time interval from when the water discharged by the second water discharge process is discharged from the water discharge port until the water discharged by the first water discharge process is discharged from the water discharge port.

4. The sanitary washing device according to claim 2, wherein the waiting time is provided so that time interval from when the first water drop formed in the first water discharge process impinges on the human body until the second water drop formed in the second water discharge process impinges on the human body is substantially equal to time interval from when the second water drop impinges on the human body until the first water drop impinges on the human body.

5. The sanitary washing device according to claim 1, further comprising:

a time reducer configured to reduce time in which pressure of the wash water drops after the second water discharge process.

6. The sanitary washing device according to claim 1, wherein the pressure of the wash water at beginning of the first water discharge process is made lower than supply water pressure.

7. The sanitary washing device according to claim 1, wherein the pressure of the wash water at beginning of the second water discharge process is made higher than the pressure of the wash water at beginning of the first water discharge process.

8. The sanitary washing device according to claim 1, wherein increment of pressure of wash water per unit time during the first time span in the first water discharge process is made smaller than increment of pressure of wash water per unit time during the second time span in the second water discharge process.

9. The sanitary washing device according to claim 1, wherein the pressurizing device includes a pressurizer configured to apply pressure to the wash water, the pressurizer performs a first pressurization on the wash water in the first water discharge process, and the pressurizer further performs a second pressurization on the wash water in the second water discharge process.

10. The sanitary washing device according to claim 9, wherein the pressurizer includes one pressurizing section, and the one pressurizing section performs the first pressurization and the second pressurization.

11. The sanitary washing device according to claim 10, wherein the pressurizer includes a cylinder connected to a supply water conduit, a plunger movably provided inside the cylinder, a check valve provided inside the plunger, and a coil configured to move the plunger forward and backward under control of an exciting voltage, and a check valve is disposed so that the pressure of the wash water increases when position of the plunger is changed to a side of the water discharge port, and that the pressure of the wash water decreases when the position of the plunger is changed to a side opposite to the water discharge port.

12. The sanitary washing device according to claim 9, wherein the pressurizer includes a first pressurizing section and a second pressurizing section, the first pressurizing section performs the first pressurization on the wash water in the first water discharge process, and the second pressurizing section performs the second pressurization on the wash water in the second water discharge process.

13. The sanitary washing device according to claim 1, wherein the pressurizing device includes:

a pressurizer configured to apply pressure to the wash water; and a pressure accumulator provided between the pressurizer and the water discharge port and configured to accumulate the pressure of the wash water, and part of the pressure applied to the wash water by the pressurizer in the second water discharge process is accumulated in the pressure accumulator, and the accumulated pressure is applied to the wash water in the first water discharge process.

14. The sanitary washing device according to claim 13, wherein the pressure accumulator applies the accumulated pressure to the wash water when the pressure of the wash water becomes lower than supply water pressure in the first water discharge process.

15. The sanitary washing device according to claim 13, wherein the pressure accumulator is formed as an elastically deformable hose used for a supply water conduit connecting between the pressurizer and the water discharge port.

16. The sanitary washing device according to claim 13, wherein in the first water discharge process, the pressure accumulator applies the pressure to the wash water, and the pressurizer performs the first pressurization.

17. The sanitary washing device according to claim 16, wherein at beginning of water discharge in the first water discharge process, the pressure accumulator applies the pressure to the wash water, and in second half of the first time span in the first water discharge process, the pressurizer performs the first pressurization.

18. The sanitary washing device according to claim 16, wherein time in which the first pressurization in the first water discharge process is performed by the pressurizer is shorter than time in which the second pressurization in the second water discharge process is performed.

19. The sanitary washing device according to claim 13, further comprising:

a time reducer configured to reduce time in which the pressure drops after the second water discharge process.

* * * * *